US011691799B2

(12) United States Patent
Digonnet et al.

(10) Patent No.: US 11,691,799 B2
(45) Date of Patent: Jul. 4, 2023

(54) BAG-IN-BOX ASSEMBLY

(71) Applicant: Dow Global Technologies LLC, Midland, MI (US)

(72) Inventors: Fabrice Digonnet, Horgen (CH); Marc S. Black, Midland, MI (US); Brian W. Walther, Freeport, TX (US); Jazmine Gosey, Freeport, TX (US); Jeffrey E. Bonekamp, Midland, MI (US)

(73) Assignee: Dow Global Technologies LLC, Midland, MI (US)

( * ) Notice: Subject to any disclaimer, the term of this patent is extended or adjusted under 35 U.S.C. 154(b) by 36 days.

(21) Appl. No.: 17/250,962

(22) PCT Filed: Sep. 27, 2019

(86) PCT No.: PCT/US2019/053532
§ 371 (c)(1),
(2) Date: Apr. 2, 2021

(87) PCT Pub. No.: WO2020/072316
PCT Pub. Date: Apr. 9, 2020

(65) Prior Publication Data

US 2021/0380321 A1 Dec. 9, 2021

Related U.S. Application Data

(60) Provisional application No. 62/741,966, filed on Oct. 5, 2018.

(51) Int. Cl.
*B65D 77/06* (2006.01)
*B67D 3/00* (2006.01)

(52) U.S. Cl.
CPC ..... *B65D 77/067* (2013.01); *B65D 77/065* (2013.01); *B67D 3/0067* (2013.01)

(58) Field of Classification Search
CPC ... B65D 77/067; B65D 77/065; B67D 3/0067
See application file for complete search history.

(56) References Cited

U.S. PATENT DOCUMENTS 3,087,655 A * 4/1963 Scholle ..... B65D 77/065 222/105
3,090,526 A * 5/1963 Hamilton ..... B65D 77/065 222/105

(Continued)

FOREIGN PATENT DOCUMENTS

JP 2011001125 A 1/2011

*Primary Examiner* — Frederick C Nicolas
(74) *Attorney, Agent, or Firm* — Quarles & Brady LLP

(57) ABSTRACT

A bag-in-box assembly includes a box and a flexible container filled with a flowable material. The flexible container includes a front panel, a rear panel, and gusseted side panels adjoining the front panel and the rear panel along peripheral seals. Each peripheral seal having an arcuate body seal inner edge (ABSIE) and a tapered seal inner edge extending from each end of a body seal. The ABSIE has a radius of curvature from 1.0 mm to 300.0 mm. The bag-in-box assembly includes a top perimeter, a center perimeter, and a bottom perimeter as well as an aggregate contact length (ACL) at each perimeter. A top ACL is from 50% to 90% of the top perimeter, a center ACL is from 5% to 50% of the center perimeter, and a bottom ACL is from 50% to 90% of the bottom perimeter.

13 Claims, 11 Drawing Sheets

(56) References Cited

U.S. PATENT DOCUMENTS 5,826,752 A * 10/1998 Latimer ..... B67D 3/0087 222/105
6,105,821 A 8/2000 Christine et al.
7,244,064 B2 7/2007 Sullivan, Jr.
8,225,958 B2 * 7/2012 Nielsen ..... B67D 3/045 383/906
8,261,964 B2 * 9/2012 Raupach ..... B65D 77/065 221/302
9,346,612 B2 5/2016 Plunkett et al.
2003/0024950 A1 2/2003 Yoneyama et al.
2008/0310766 A1 * 12/2008 Plunkett ..... B65D 88/62 383/17
2009/0159594 A1 * 6/2009 Nielsen ..... B67D 3/045 222/105
2010/0065581 A1 * 3/2010 Thomason ..... B65D 77/067 222/105
2011/0056965 A1 * 3/2011 Peer ..... B65D 75/563 220/661
2011/0069908 A1 * 3/2011 Wilkes ..... B65D 35/02 383/42
2011/0193917 A1 * 8/2011 Enderle ..... B41J 2/17593 347/85
2012/0205396 A1 * 8/2012 Edwards ..... B65D 77/067 222/105
2012/0248146 A1 * 10/2012 Knudsen ..... B65D 77/067 248/314
2012/0318821 A1 * 12/2012 Merner ..... B67D 3/04 222/105
2014/0199002 A1 * 7/2014 Murray ..... B65D 77/28 383/119
2017/0121082 A1 5/2017 Tiwari et al.
2020/0148454 A1 5/2020 Black et al.

* cited by examiner

BAG-IN-BOX ASSEMBLY

BACKGROUND

The present disclosure is directed to a bag-in-box assembly for dispensing a flowable material.

Known are bag-in-box assemblies containing flexible containers. Also known are flexible containers with a flexible gusseted body section. These gusseted flexible containers are currently produced using flexible films which are folded to form gussets and heat sealed in a perimeter shape. The gusseted body section opens to form a flexible container with a square cross section or a rectangular cross section. The gussets are terminated at the bottom of the container to form a substantially flat base, providing stability when the container is partially or wholly filled. The flat base yields a self-standing flexible container, otherwise known as a stand-up pouch, or "SUP."

Performance attributes for SUPs include aspect ratio and drop performance. The aspect ratio is the relationship between the bag-in-box assembly height and the bag-in-box assembly width. Drop performance is the resistance of the filled bag-in-box assembly to bulge or suffer some distortion of shape when dropped. A larger aspect ratio (i.e., a taller bag-in-box assembly) is oftentimes desirable in the retail setting, for example, because a larger aspect ratio translates into effective shelf space utilization and increased advertising area upon the bag-in-box assembly, drawing consumer appeal. However as aspect ratio increases, drop performance generally decreases. Maximizing bag-in-box assembly efficiency is characterized by these relationships.

The art recognizes the need for bag-in-box assemblies with an increased aspect ratio without degradation to drop performance. Further desired in the art is an SUP with increased aspect ratio and sufficient drop performance to operate in the retail, commercial, industrial, and/or household environments.

SUMMARY

The present disclosure provides a bag-in-box assembly. The bag-in-box assembly includes a box having an inner surface, the inner surface defining a compartment and a flexible container filled with a flowable material, the flexible container located in the compartment. The flexible container includes a front panel, a rear panel, a first gusseted side panel, and a second gusseted side panel, the gusseted side panels adjoining the front panel and the rear panel along peripheral seals to form a chamber. Each peripheral seal has (i) an arcuate body seal inner edge (ABSIE) with opposing ends and (ii) a tapered seal inner edge extending from each end of the body seal. The flexible container comprises at least one ABSIE having a radius of curvature from 1.0 mm to 300.0 mm.

In an embodiment, the bag-in-box assembly also includes a top perimeter, a center perimeter, and a bottom perimeter as well as an aggregate contact length (ACL) at each perimeter. A top ACL is from 50% to 90% of the top perimeter, a center ACL is from 5% to 50% of the center perimeter, and a bottom ACL is from 50% to 90% of the bottom perimeter. The bag-in-box assembly is capable of passing a one meter drop test in accordance with drop test method A.

BRIEF DESCRIPTION OF THE DRAWINGS

FIG. 3A is a top plan view of the bag-in-box assembly of FIG. 3AA after the one meter drop test, in accordance with an embodiment of the present disclosure.

FIG. 3B is a top plan view of the conventional bag-in-box assembly of FIG. 3BB after the one meter drop test.

DEFINITIONS

Figure 2:
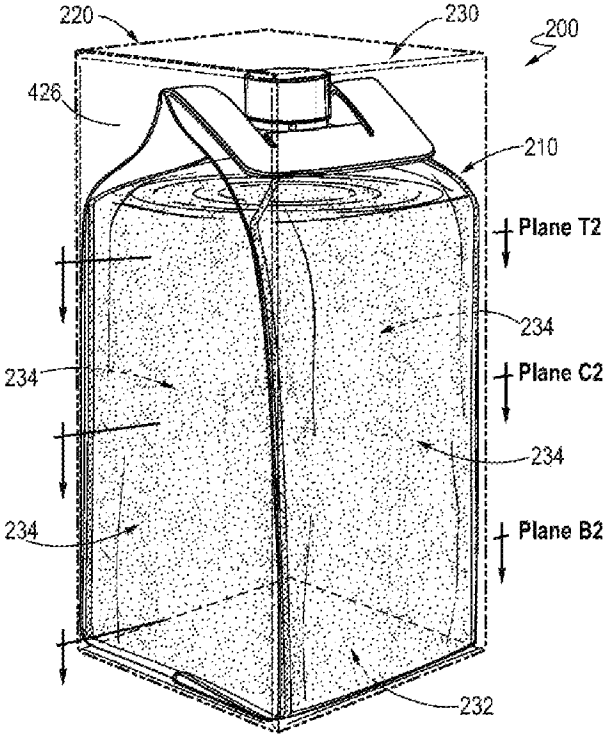
FIG. 2 is a perspective view of a conventional bag-in-box assembly.

The numerical ranges disclosed herein include all values from, and including, the lower value and the upper value. For ranges containing explicit values (e.g., 1, or 2, or 3 to 5, or 6, or 7) any subrange between any two explicit values is included (e.g., 1 to 2; 2 to 6; 5 to 7; 3 to 7; 5 to 6; etc.).

Unless stated to the contrary, implicit from the context, or customary in the art, all parts and percents are based on weight, and all test methods are current as of the filing date of this disclosure.

The term "composition," as used herein, refers to a mixture of materials which comprise the composition, as well as reaction products and decomposition products formed from the materials of the composition.

The terms "comprising," "including," "having," and their derivatives, are not intended to exclude the presence of any additional component, step or procedure, whether or not the same is specifically disclosed. In order to avoid any doubt, all compositions claimed through use of the term "comprising" may include any additional additive, adjuvant, or compound, whether polymeric or otherwise, unless stated to the contrary. In contrast, the term, "consisting essentially of" excludes from the scope of any succeeding recitation any other component, step or procedure, excepting those that are not essential to operability. The term "consisting of" excludes any component, step or procedure not specifically delineated or listed.

An "ethylene-based polymer," as used herein is a polymer that contains more than 50 weight percent polymerized ethylene monomer (based on the total amount of polymerizable monomers) and, optionally, may contain at least one comonomer.

The term "heat seal initiation temperature," is minimum sealing temperature required to form a seal of significant strength, in this case, 2 lb/in (8.8N/25.4 mm). The seal is performed in a Topwave HT tester with 0.5 seconds dwell time at 2.7 bar (40 psi) seal bar pressure. The sealed specimen is tested in an Instron Tensiomer at 4.2 mm/sec (10 in/min or 250 mm/min).

Tm or "melting point" as used herein (also referred to as a melting peak in reference to the shape of the plotted DSC curve) is typically measured by the DSC (Differential Scanning calorimetry) technique for measuring the melting points or peaks of polyolefins as described in U.S. Pat. No. 5,783,638. It should be noted that many blends comprising two or more polyolefins will have more than one melting point or peak, many individual polyolefins will comprise only one melting point or peak.

An "olefin-based polymer," as used herein is a polymer that contains more than 50 weight percent polymerized olefin monomer (based on total amount of polymerizable monomers), and optionally, may contain at least one comonomer. Nonlimiting examples of olefin-based polymer include ethylene-based polymer and propylene-based polymer.

A "polymer" is a compound prepared by polymerizing monomers, whether of the same or a different type, that in polymerized form provide the multiple and/or repeating "units" or "mer units" that make up a polymer. The generic term polymer thus embraces the term homopolymer, usually employed to refer to polymers prepared from only one type of monomer, and the term copolymer, usually employed to refer to polymers prepared from at least two types of monomers. It also embraces all forms of copolymer, e.g., random, block, etc. The terms "ethylene/α-olefin polymer" and "propylene/α-olefin polymer" are indicative of copolymer as described above prepared from polymerizing ethylene or propylene respectively and one or more additional, polymerizable α-olefin monomer. It is noted that although a polymer is often referred to as being "made of" one or more specified monomers, "based on" a specified monomer or monomer type, "containing" a specified monomer content, or the like, in this context the term "monomer" is understood to be referring to the polymerized remnant of the specified monomer and not to the unpolymerized species. In general, polymers herein are referred to has being based on "units" that are the polymerized form of a corresponding monomer.

A "propylene-based polymer" is a polymer that contains more than 50 weight percent polymerized propylene monomer (based on the total amount of polymerizable monomers) and, optionally, may contain at least one comonomer.

TEST METHODS

ASTM F1249. Moisture permeability is a normalized calculation performed by first measuring Water Vapor Transmission Rate (WVTR) of the film and then multiplying WVTR by the film thickness. Thickness is typically measured in units of mil where 1 mil=0.001 in. WVTR is measured at 38° C., 100% relative humidity and 1 atm pressure with a MOCON Permatran-W 3/31. For values of WVTR at 90% relative humidity the measured WVTR (at 100% relative humidity) is multiplied by 0.90. The instrument is calibrated with National Institute of Standards and Technology certified 25 μm-thick polyester film of known water vapor transport characteristics. The specimens are prepared and the WVTR is performed according to ASTM F1249. WVTR units are $g/m^2/24$ hr.

ASTM D 3985. Oxygen permeability is a normalized calculation performed by first measuring Oxygen Transmission Rate (OTR) for a given film thickness and then multiplying this measured OTR by the film thickness (typically measured in units of mil). OTR is measured at 23° C., 50% relative humidity and 1 atm pressure with a MOCON OX-TRAN 2/20. The instrument is calibrated with National Institute of Standards and Technology certified Mylar film of known $O_2$ transport characteristics. The specimens are prepared and the OTR is performed according to ASTM D 3985. Typical OTR units are $cc/m^2/24$ hr/atm.

Drop Test Method A: One Meter Drop Test. An outer surface of a bag-in-box assembly is evaluated for distortion of the flatness of the outer surface. The bag is filled with fluid content and the bag is installed into the box. Pre-drop distortion is measured before the assembly is dropped and post-drop distortion is measured after the drop.

Measurement of distortion is determined by holding a ruler against an exterior box surface (e.g., at the bottom of the box). In cases where the entire length of the ruler rests flat against the box surface, the measured surface is considered to have no distortion, i.e., the measured surface is flat. Distortion of the surface is observed when the entire length of the ruler is not resting flat against the box surface. The distance between the ruler and the box surface corresponds to the distortion of the box surface. The distortion is experimentally determined by placing the ruler against an outermost point of the box while holding the ruler parallel with a line connecting the two corners of the box at the side being measured. The distance between the ruler and the box surface in a direction perpendicular to the ruler is measured at each of the two corners of the box. The larger of the two measurements represents the distortion. The ruler is slid vertically along the box surface while observing the distortion and a point where the distortion is the greatest is identified. Distortion measurements are obtained for all of the box side walls and the maximum distortion value among all of the individual measurements is reported as a single distortion value. Typically the maximum distortion is found around a vertical mid-point, i.e., a point that is midway between the bottom of the box and the top of the box. Drop Test Method A determines distortion at any location of the box.

Box bulge is termed as "drop-related distortion" where drop-related distortion equals post-drop distortion minus pre-drop distortion. Pre-drop distortion is typically not present but can be observed when the box walls are constructed from lightweight material and/or material having a thickness less than, or equal to, 0.3 cm.

To conduct the one meter drop test the sample is elevated one meter above a smooth concrete surface. The temperature of the sample, and the contents therein, is allowed to reach ambient conditions (e.g., from 22° C. to 28° C.) and the sample is allowed to fall freely through a one meter vertical distance. Samples containing a flexible container inside of the box are dropped such that the bottom surface is parallel to the floor upon contact. After dropping the sample, the surface distortion is measured as described in the Drop Test Method A procedure.

DETAILED DESCRIPTION

Figure 1:
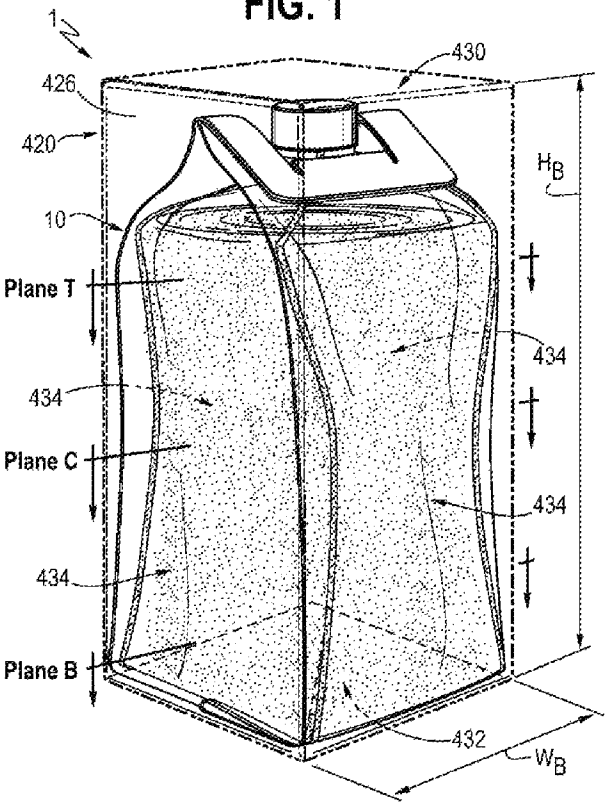
FIG. 1 is a perspective view of a bag-in-box assembly with the outer box shown in phantom lines in order to show the geometry of the inner flexible container in accordance with an embodiment of the present disclosure.

Referring to the drawings and initially to FIG. 1, a bag-in-box (BIB) assembly as provided by the present disclosure is indicated by the reference numeral 1. In an embodiment, the BIB assembly 1 includes a flexible container 10 and a box 420.

FIG. 1 shows box 420 in phantom in order to illustrate the spatial geometry between the box 420 and the flexible container 10. It is understood that box 420 includes six walls with structure as described in detail below. The BIB assembly 1 can be used to store and transport flowable substances (e.g., flowable food products) as further described herein. In an embodiment, the BIB assembly 1 is used to store and transport beverages, such as wine, for example.

A. Bag

The bag-in-box assembly as provided by the present disclosure includes a flexible container. In an embodiment, the flexible container includes (A) a front panel, a rear panel, a first gusseted side panel, and a second gusseted side panel. The gusseted side panels adjoin the front panel and the rear panel along peripheral seals to form a chamber. (B) Each peripheral seal has (i) an arcuate body seal inner edge (ABSIE) with opposing ends, and (ii) a tapered seal inner edge (TSIE) extending from each end of the body seal. (C) The flexible container has at least one ABSIE having a radius of curvature, Rc, from 1.0 millimeter (mm), or 3.0 mm, or 5.0 mm, or 7.0 mm, or 8.0 mm, or 8.5 mm, or 9.0 mm, or 9.5 mm, or 10.0 mm, or 10.5 mm, or 11.0 mm, or 13.0 mm, or 15.0 mm, or 20.0 mm, or 25.0 mm, or 50.0 mm, or 75.0 mm, or 100.0 mm to 150.0 mm, or 200.0 mm, or 250.0 mm, or 300.0 mm.

Figure 5:
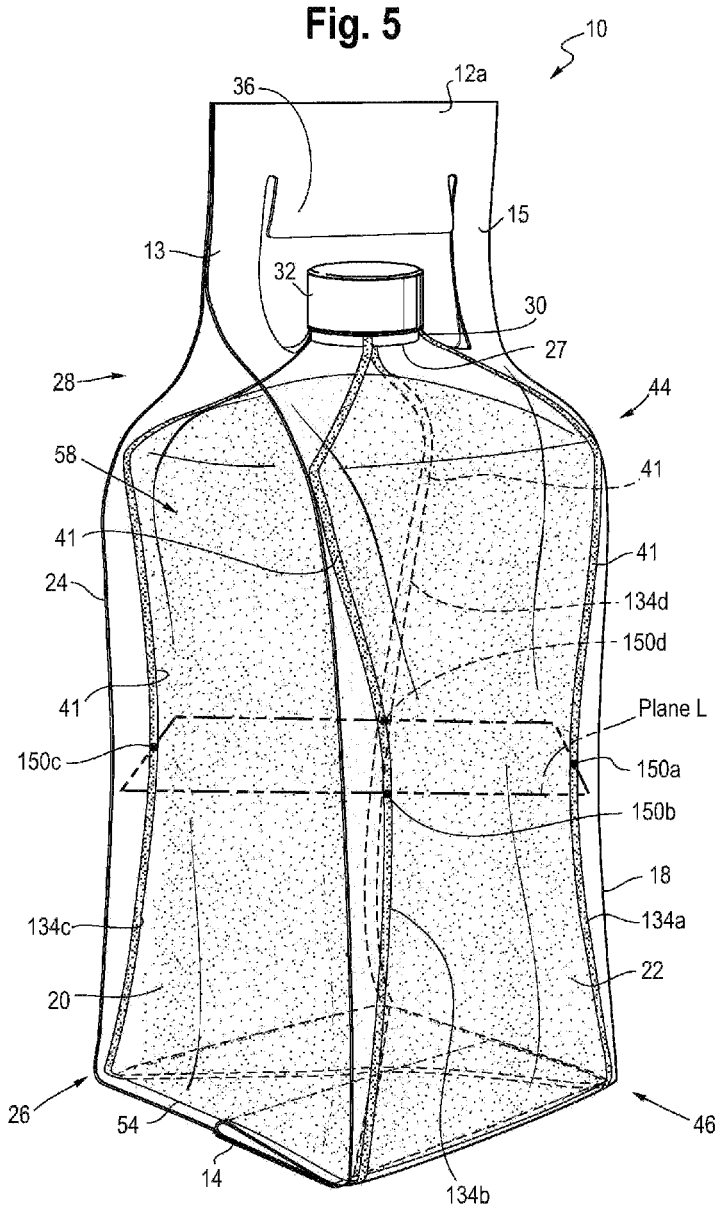
FIG. 5 is a perspective view of a filled self-standing flexible container having top and bottom flexible handles in accordance with an embodiment of the present disclosure.
Figure 6:
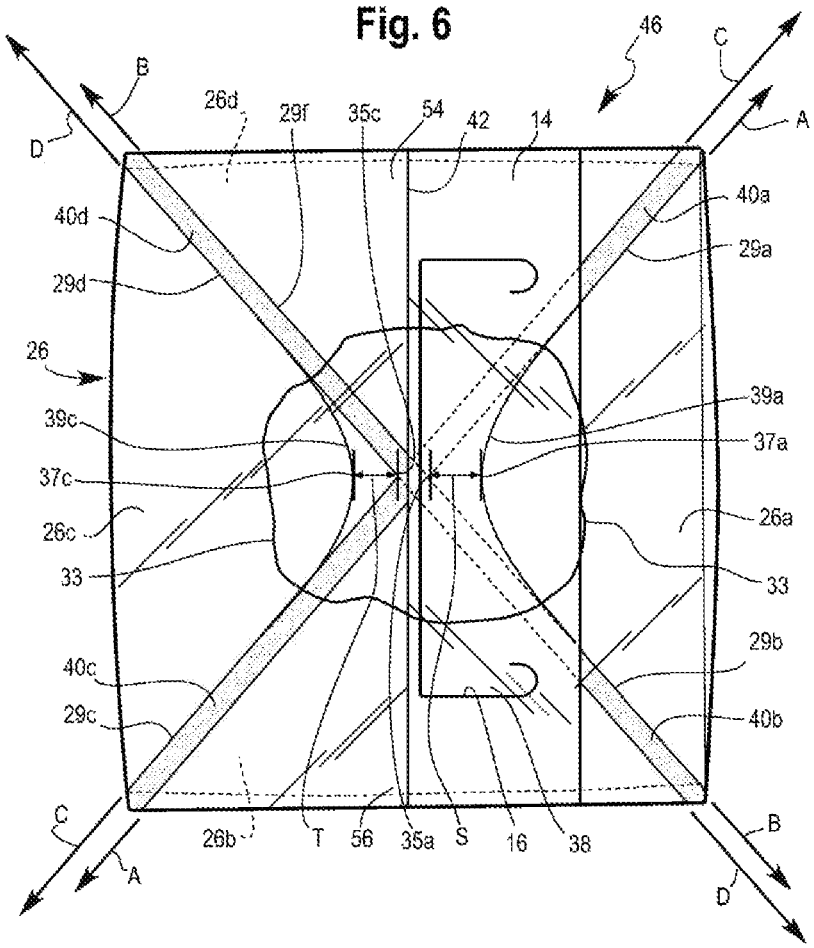
FIG. 6 is a bottom plan view of the flexible container of FIG. 5.

FIGS. 5-6 show a flexible container 10 having four panels, a front panel 22, a back panel 24, a first gusset panel 18 and a second gusset panel 20. The four panels 18, 20, 22, and 24 extend toward a top end 44 and a bottom end 46 of the flexible container 10 to form the top segment 28 and bottom segment 26, respectively. When the flexible container 10 is inverted, the top and bottom positions in relation to the container 10 change. However, for consistency the handle adjacent the spout 30 will be called the top or upper handle 12 and the opposite handle will be called the bottom or lower handle 14. Likewise, the top segment will be the surface adjacent the spout 30, and the bottom segment will be the surface opposite the top segment.

The four panels 18, 20, 22 and 24 each can be composed of a separate web of film. The composition and structure for each web of film can be the same or different. Alternatively, one web of film may also be used to make all four panels and the top and bottom segments. In a further embodiment, two or more webs can be used to make each panel.

In an embodiment, four webs of multilayer film are provided, one web of multilayer film for each respective panel 18, 20, 22, and 24. The edges of each multilayer film are sealed to the adjacent web of film to form peripheral seals 41 (FIG. 5). The peripheral tapered seals 40*a*-40*d* are located on the bottom segment 26 of the container as shown in FIG. 6. The peripheral seals 41 are located on the side edges of the container 10. Peripheral tapered seals 40*a*-40*d* are located on the bottom segment 26 of the container as shown in FIG. 6. The sealed panels 18, 20, 22, 24 from an interior chamber.

To form the top segment 28 and the bottom segment 26, the four webs of film converge together at the respective end and are sealed together. For instance, the top segment 28 can be defined by extensions of the panels sealed together at the top end 44 and when the flexible container 10 is in a rest position it can have four top panels 28*a*-28*d* (FIG. 8) of film that define the top segment 28. The bottom segment 26 can also have four bottom panels 26*a*-26*d* of film sealed together and can also be defined by extensions of the panels at the opposite end 46 as shown in FIG. 6.

In an embodiment, a portion of each of the four panels 18, 20, 22, 24 (front panel, rear panel, first gusseted side panel, second gusseted side panel) form the top segment 28 and terminate at a neck 27. In this way, each panel extends from the bottom segment to the neck 27. At the neck 27, a portion of a top end section of each of the four panels 18, 20, 22, 24 is sealed, or otherwise is welded, to a spout 30 to form a tight seal. The spout 30 is sealed to the neck 27 by way of compression heat seal, ultrasonic seal, and combinations thereof. Although the base of spout 30 has a circular cross-sectional shape, it is understood that the base of spout 30 can have other cross-sectional shapes such as a polygonal cross-sectional shape, for example. The base with circular cross-sectional shape is distinct from fitments with canoe-shaped bases used for conventional two-panel flexible pouches.

In an embodiment, the outer surface of the base of spout 30 has surface texture. The surface texture can include embossment and a plurality of radial ridges to promote sealing to the inner surface of the top segment 28.

In an embodiment, the spout 30 excludes fitments with oval, wing-shaped, eye-shaped, or canoe-shaped bases.

Furthermore, the spout 30 can contain a removable closure 32. Alternatively, the spout 30 can be positioned on one of the panels, where the top segment would then be defined as an upper seal area defined by the joining together of at least two panel ends. In a further embodiment, the spout 30 is positioned at generally a midpoint of the top segment 28 and can be sized smaller than a width of the container 10, such that the spout 30 can have an area that is less than a total area of the top segment 28. In yet a further embodiment, the spout area is not more than 20% of the total top segment area. This can ensure that the spout 30 will not be large enough to insert a hand therethrough, thus avoiding any unintentional contact with the product 58 stored therein.

The spout 30 can be made of a rigid construction and can be formed of any appropriate plastic, such as high density polyethylene (HDPE), low density polyethylene (LDPE), polypropylene (PP), and combinations thereof. The location of the spout 30 can be anywhere on the top segment 28 of the container 10. In an embodiment, the spout 30 is located at the center or midpoint of the top segment 28. The closure 32 covers the spout 30 and prevents the product from spilling out of the container 10. The closure 32 may be a screw-on cap, a flip-top cap or other types of removable (and optionally reclosable) closures.

In an embodiment, the flexible container does not have a rigid spout and the panels are sealed across the neck, by way of a releasable seal (tear seal), for example.

As shown in FIGS. 5-6, the flexible bottom handle 14 can be positioned at a bottom end 46 of the container 10 such that the bottom handle 14 is an extension of the bottom segment 26.

Each panel includes a respective bottom face. FIG. 6 shows four triangle-shaped bottom faces 26*a*, 26*b*, 26*c*, 26*d*, each bottom face being an extension of a respective film panel. The bottom faces 26*a*-26*d* make up the bottom segment 26. The four panels 26*a*-26*d* come together at a midpoint of the bottom segment 26. The bottom faces 26*a*-26*d* are sealed together, such as by using a heat-sealing technology, to form the bottom handle 14. For instance, a weld can be made to form the bottom handle 14, and to seal the edges of the bottom segment 26 together. Nonlimiting examples of suitable heat-sealing technologies include hot bar sealing, hot die sealing, impulse sealing, high frequency sealing, or ultrasonic sealing methods.

Figure 7:
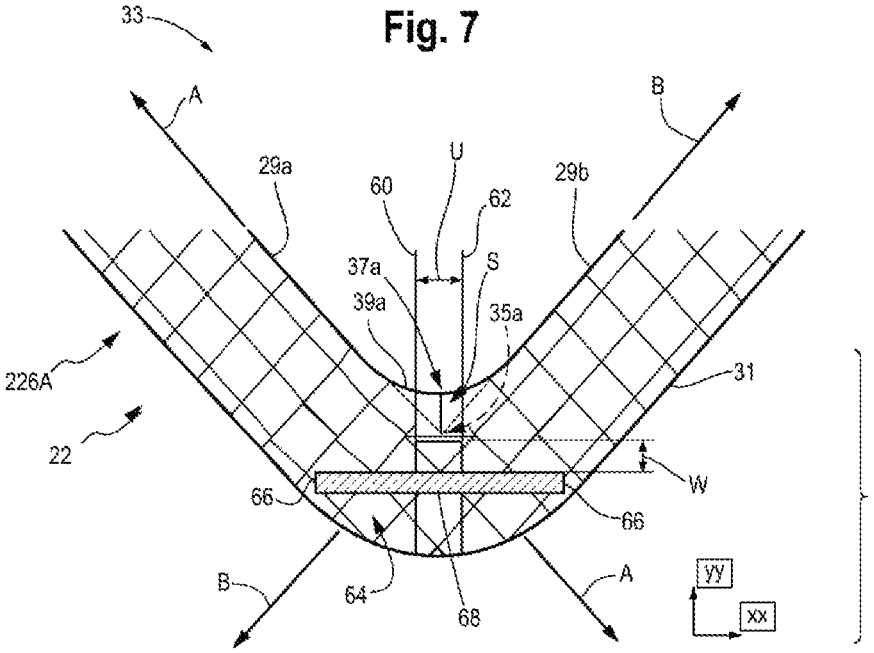
FIG. 7 is an enlarged view of the bottom seal area of FIG. 6.
Figure 9:
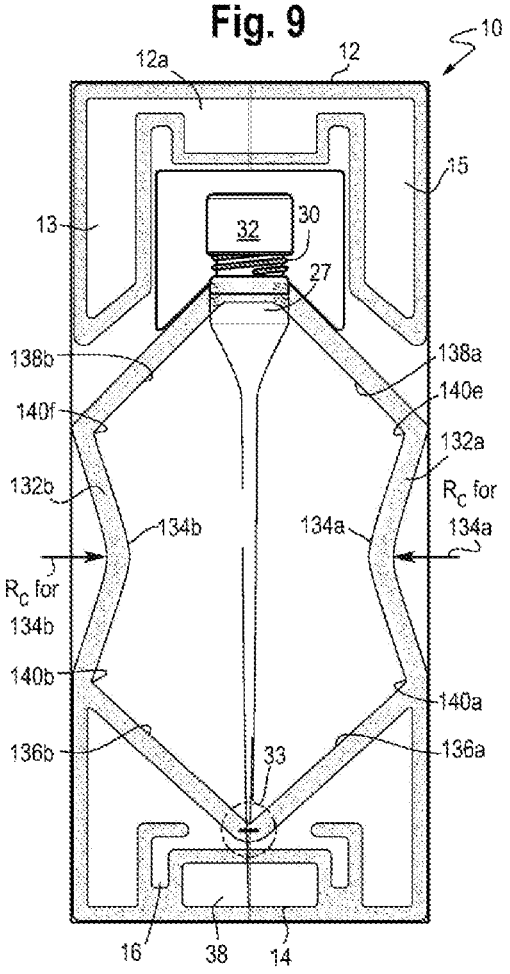
FIG. 9 is a perspective view of the container of FIG. 5 in a collapsed configuration.

FIG. 6 shows bottom segment 26. Each panel 18, 20, 22, 24 has a respective bottom face 26*a*, 26*b*, 26*c*, 26*d* that is present in the bottom segment 26. Each bottom face is bordered by two opposing peripheral tapered seals 40*a*, 40*b*, 40*c*, 40*d*. Each peripheral tapered seal 40*a*-40*d* extends from a respective peripheral seal 41. The peripheral tapered seals for the front panel 22 and the rear panel 24 have an inner edge 29*a*-29*d* (FIG. 6) and an outer edge 31 (FIG. 7). The peripheral tapered seals 40*a*-40*d* converge at a bottom seal area 33 (FIG. 6, FIG. 7, FIG. 9).

The front panel bottom face 26*a* includes a first line A defined by the inner edge 29*a* of the first peripheral tapered seal 40*a* and a second line B defined by the inner edge 29*b* of the second peripheral tapered seal 40*b*. The first line A intersects the second line B at an apex point 35*a* in the bottom seal area 33. The front panel bottom face 26*a* has a bottom distalmost inner seal point 37*a* ("BDISP 37*a*"). The BDISP 37*a* is located on an inner seal edge defined by inner edge 29*a* and inner edge 29*b*.

The apex point 35*a* is separated from the BDISP 37*a* by a distance S from 0 millimeter (mm) to less than 8.0 mm.

In an embodiment, the rear panel bottom face 26*c* includes an apex point similar to the apex point on the front panel bottom face. The rear panel bottom face 26*c* includes a first line C defined by the inner edge of the 29*c* first peripheral tapered seal 40*c* and a second line D defined by the inner edge 29*d* of the second peripheral tapered seal 40*d*. The first line C intersects the second line D at an apex point 35*c* in the bottom seal area 33. The rear panel bottom face 26*c* has a bottom distalmost inner seal point 37*c* ("BDISP 37*c*"). The BDISP 37*c* is located on an inner seal edge defined by inner edge 29*c* and inner edge 29*d*. The apex point 35*c* is separated from the BDISP 37*c* by a distance T from 0 millimeter (mm) to less than 8.0 mm.

It is understood the following description to the front panel bottom face applies equally to the rear panel bottom face, with reference numerals to the rear panel bottom face shown in adjacent closed parentheses.

In an embodiment, the BDISP 37*a* (37*c*) is located where the inner edges 29*a* (29*c*) and 29*b* (29*d*) intersect. The distance between the BDISP 37*a* (37*c*) and the apex point 35*a* (35*c*) is 0 mm.

In an embodiment, the inner seal edge diverges from the inner edges 29*a*, 29*b* (29*c*, 29*d*), to form a distal inner seal arc 39*a* (front panel) a distal inner seal arc 39*c* (rear panel) as shown in FIGS. 6 and 7. The BDISP 37*a* (37*c*) is located on the inner seal arc 39*a* (39*c*). The apex point 35*a* (apex point 35*c*) is separated from the BDISP 37*a* (BDISP 37*c*) by the distance S (distance T) which is from greater than 0 mm, or 1.0 mm, or 2.0 mm, or 2.6 mm, or 3.0 mm, or 3.5 mm, or 3.9 mm, to 4.0 mm, or 4.5 mm, or 5.0 mm, or 5.2 mm, or 5.3 mm, or 5.5 mm, or 6.0 mm, or 6.5 mm, or 7.0 mm, or 7.5 mm, or 7.9 mm.

In an embodiment, apex point 35*a* (35*c*) is separated from the BDISP 37*a* (37*c*) by the distance S (distance T) which is from greater than 0 mm to less than 6.0 mm.

In an embodiment, the distance from S (distance T) from the apex point 35*a* (35*c*) to the BDISP 37*a* (37*c*) is from greater than 0 mm, or 0.5 mm, or 1.0 mm, or 2.0 mm to 4.0 mm, or 5.0 mm, or less than 5.5 mm.

In an embodiment, apex point 35*a* (apex point 35*c*) is separated from the BDISP 37*a* (BDISP 37*c*) by the distance S (distance T) which is from 3.0 mm, or 3.5 mm, or 3.9 mm to 4.0 mm, or 4.5 mm, or 5.0 mm, or 5.2 mm, or 5.3 mm, or 5.5 mm.

In an embodiment, the distal inner seal arc 39*a* (39*c*) has a radius of curvature from 0 mm, or greater than 0 mm, or 1.0 mm to 19.0 mm, or 20.0 mm.

The bottom segment 26 includes a pair of gussets 54 and 56 formed thereat, which are essentially extensions of the bottom faces 26*a*-26*d*. The gussets 54 and 56 can facilitate the ability of the flexible container 10 to stand upright. These gussets 54 and 56 are formed from excess material from each bottom face 26*a*-26*d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26*a*-26*b* and 26*b*-26*c*. The gussets 54 and 56 can contact a portion of the bottom segment 26, where the gussets 54 and 56 can contact bottom faces 26*b* and 26*d* covering them, while bottom segment panels 26*a* and 26*c* remain exposed at the bottom end 46.

As shown in FIGS. 5-6, the gussets 54 and 56 of the flexible container 10 can further extend into the bottom handle 14. In the aspect where the gussets 54 and 56 are positioned adjacent bottom segment panels 26*b* and 26*d*, the bottom handle 14 can also extend across bottom faces 26*b* and 26*d*, extending between the pair of panels 18 and 20. The bottom handle 14 can be positioned along a center portion or midpoint of the bottom segment 26 between the front panel 22 and the rear panel 24.

The bottom handle 14 can comprise up to four layers of film (one layer for each panel 18, 20, 22, 24) sealed together when four webs of film are used to make the container 10. When more than four webs are used to make the container, the handle will include the same number of webs used to produce the container. Any portion of the bottom handle 14 where all four layers are not completely sealed together by the heat-sealing method, can be adhered together in any appropriate manner, such as by a tack seal to form a fully-sealed multi-layer bottom handle 14. The bottom handle 14 can have any suitable shape and generally will take the shape of the film end. For example, typically the web of film has a rectangular shape when unwound, such that its ends have a straight edge. Therefore, the bottom handle 14 would also have a rectangular shape.

Additionally, the bottom handle 14 can contain a handle opening 16 or cutout section therein sized to fit a user's hand. The opening 16 can be any shape that is convenient to fit the hand and, in one aspect, the opening 16 can have a generally oval shape. In another aspect, the opening 16 can have a generally rectangular shape. Additionally, the opening 16 of the bottom handle 14 can also have a flap 38 that comprises the cut material that forms the opening 16. To define the opening 16, the handle 14 can have a section that is cut out of the multilayer handle 14 along three sides or portions while remaining attached at a fourth side or lower portion. This provides a flap of material 38 that can be pushed through the opening 16 by the user and folded over an edge of the opening 16 to provide a relatively smooth gripping surface at an edge that contacts the user's hand. If the flap of material were completely cut out, this would leave an exposed fourth side or lower edge that could be relatively sharp and could possibly cut or scratch the hand when placed there.

Furthermore, a portion of the bottom handle 14 attached to the bottom segment 26 can contain a dead machine fold 42 or a score line that provides for the handle 14 to consistently fold in the same direction, as illustrated in FIG. 6. The machine fold 42 can comprise a fold line that permits folding in a first direction toward the front side panel 22 and restricts folding in a second direction toward the rear panel 24. The term "restricts" as used throughout this application can mean that it is easier to move in one direction, or the first direction, than in an opposite direction, such as the second direction. The machine fold 42 can cause the handle 14 to consistently fold in the first direction because it can be thought of as providing a generally permanent fold line in the handle that is predisposed to fold in the first direction. This machine fold 42 of the bottom handle 14 can serve multiple purposes, one being that when a user is transferring the product from the container 10 they can grasp the bottom handle 14 and it will easily bend in the first direction to assist in pouring. Secondly, when the flexible container 10 is stored in an upright position, the machine fold 42 in the bottom handle 14 encourages the handle 14 to fold in the first direction along the machine fold 42, such that the bottom handle 14 can fold underneath the container 10 adjacent one of the bottom segment panels 26*a*, as shown in FIG. 6. The weight of the product can also apply a force to the bottom handle 14, such that the weight of the product can further press on the handle 14 and maintain the handle 14 in the folded position in the first direction. In an embodiment, the top handle 12 can contain a similar machine fold 34*a*-34*b* that also allows it to fold consistently in the same first direction as the bottom handle 14.

Additionally, as the flexible container 10 is evacuated and less product remains, the bottom handle 14 can continue to provide support to help the flexible container 10 to remain standing upright unsupported and without tipping over. Because the bottom handle 14 is sealed generally along its entire length extending between the pair of side panels 18 and 20, it can help to keep the gussets 54 and 56 (FIG. 5, FIG. 6) together and continue to provide support to stand the container 10 upright even as the container 10 is emptied.

Figure 8:
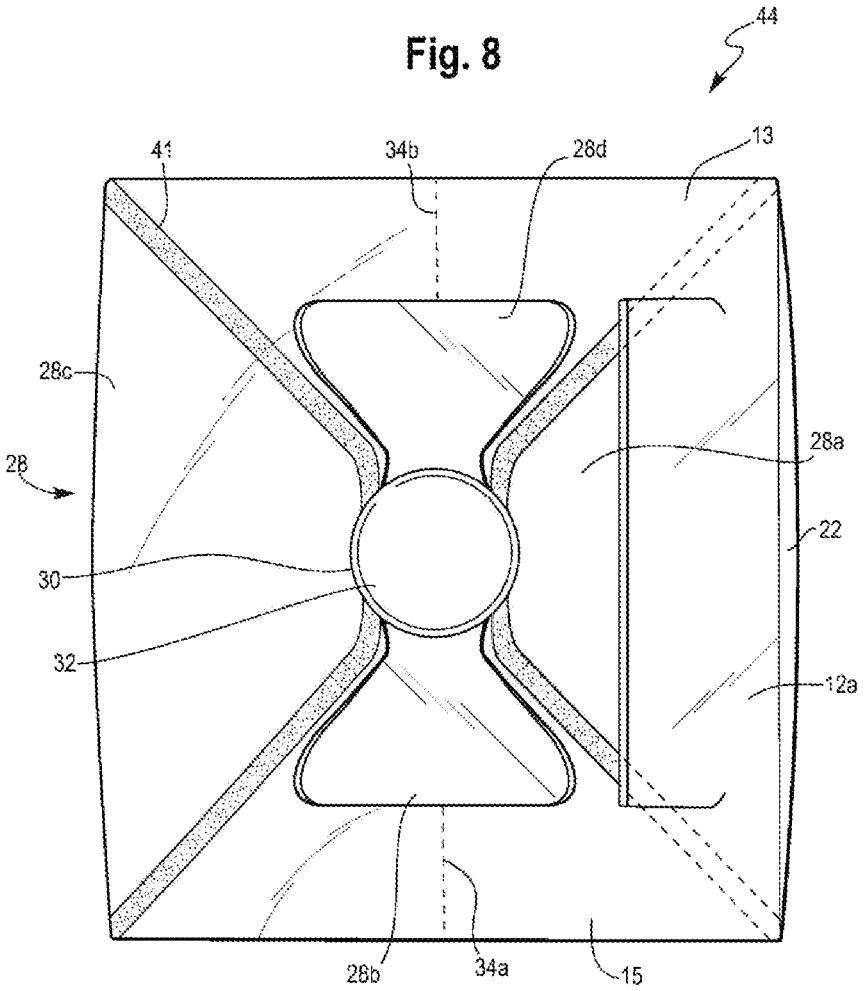
FIG. 8 is a top plan view of the flexible container of FIG. 5.

As seen in FIGS. 5 and 9, the top handle 12 extends vertically, or substantially vertically, upward from the top segment 28 and, in particular, can extend from the four panels 28*a*-28*d* that make up the top segment 28. As shown in FIGS. 5 and 8, the four panels 28*a*-28*d* of film that extend into the top handle 12 are all sealed together to form a multi-layer top handle 12. The top handle 12 can have a U-shape and, in particular, an upside down U-shape with a horizontal upper handle portion 12*a* having a pair of spaced legs 13 and 15 extending therefrom. The legs 13 and 15 extend from the top segment 28, adjacent the spout 30 with one leg 13 on one side of the spout 30 and other leg 15 on the other side of the spout 30, with each leg 13, 15 extending from opposite portions of the top segment 28.

The bottommost edge of the upper handle portion 12*a* when extended in a position above the spout 30, is tall enough to clear the uppermost edge of the spout 30. A portion of the top handle 12 can extend above the spout 30 and above the top segment 28 when the handle 12 is extended in a position perpendicular to the top segment 28 and, in particular, the entire upper handle portion 12*a* can be above the spout 30 and the top segment 28. The two pairs of legs 13 and 15 along with the upper handle portion 12*a* together make up the handle 12 surrounding a handle opening that allows a user to place her hand therethrough and grasp the upper handle portion 12*a* of the handle 12.

In an embodiment, the top handle is a stand-up top handle 12 as shown in FIG. 5. A "stand-up top handle," as used herein, is a top handle formed from the four panels and is fabricated (e.g., sealed) such that upper handle portion 12*a* is above the spout 30 when flexible container 10 is in the expanded configuration. The stand-up top handle 12 is formed to stand, or otherwise to extend vertically, or substantially vertically, upright from top segment 28 such that the horizontal upper handle portion 12*a* is positioned above the spout 30 without manipulation by a person. In this sense, the stand-up top handle is "self-standing."

In an embodiment, the top handle 12 can have a dead machine fold 34*a*-34*b* that permits folding in a first direction toward the front side panel 22 and restricts folding in a second direction toward the rear side panel 24. The machine fold 34*a*-34*b* can be located in each leg 13, 15 at a location where the seal begins. The handle 12 can be adhered together, such as with a tack adhesive, beginning from the machine folded portion 34*a*-34*b* up to and including the horizontal upper handle portion 12*a* of the handle 12. Alternatively, two machine folds 34*a*-34*b* in the handle 12 can allow for the handle 12 to be inclined to fold or bend consistently in the same first direction as the bottom handle 14, rather than in the second direction. As shown in FIG. 5, the handle 12 can likewise contain a flap portion 36, that folds upwards toward the upper handle portion 12*a* of the handle 12 to create a smooth gripping surface of the handle 12, as with the bottom handle 14, such that the handle material is not sharp and can protect the user's hand from getting cut on any sharp edges of the handle 12.

When the container 10 is in a rest position, such as when it is standing upright on its bottom segment 26, as shown in FIG. 5, the bottom handle 14 can be folded underneath the container 10 along the bottom machine fold 42 in the first direction, so that it is parallel to the bottom segment 26 and adjacent bottom panel 26*a*, and the top handle 12 extends straight up, with horizontal handle portion 12*a* above the spout 30. The flexible container 10 can stand upright even with the bottom handle 14 positioned underneath the upright flexible container 10.

In an embodiment, the flexible container can contain a fitment or pour spout positioned on a side wall, where the top handle is essentially formed in and from the top portion or segment. The top handle can be formed from the four panels 18, 20, 22, 24, each panel extending from its respective side wall, extending into a side wall or flap positioned at the top end of the container, such that the top segment of the container converges into the handle and they are one and the same, with the spout to the side of the extended handles, rather than underneath.

The material of construction of the flexible container 10 can comprise a food-grade plastic. For instance, nylon, polypropylene, polyethylene such as high density polyethylene (HDPE) and/or low density polyethylene (LDPE) may be used as discussed later. The film of the flexible container 10 can have a thickness that is adequate to maintain product and package integrity during manufacturing, distribution, product shelf life and customer usage. In an embodiment, the flexible multilayer film for each panel has a thickness from 100 micrometers, or 200 micrometers, or 250 micrometers to 300 micrometers, or 350 micrometers, or 400 micrometers. The film material can also be such that it provides the appropriate atmosphere within the flexible container 10 to maintain the product shelf life of at least about 180 days. Such multilayer films can comprise an oxygen barrier film, such as a film having a low oxygen transmission rate (OTR) from 0, or greater than 0 to 0.4, or 1.0 cc/$m^2$/24 h/atm) at 23° C. and 80% relative humidity (RH). Additionally, the flexible multilayer film that forms each panel can also comprise a water vapor barrier film, such as a film having a low water vapor transmission rate (WVTR) from 0, or greater than 0, or 0.2, or 1.0 to 5.0, or 10.0, or 15.0 g/$m^2$/24 h at 38° C. and 90% RH. Moreover, it may be desirable to use materials of construction having oil and/or chemical resistance particularly in the seal layer, but not limited to just the seal layer. The flexible multilayer film can be either printable or compatible to receive a pressure sensitive label or other type of label for displaying of indicia on the flexible container 10.

In an embodiment, each panel 18, 20, 22, 24 is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible. Film layers can comprise, in addition to the polymeric materials, additives such as stabilizers, slip additives, antiblocking additives, process aids, clarifiers, nucleators, pigments or colorants, fillers and reinforcing agents, and the like as commonly used in the packaging industry. It is particularly useful to choose additives and polymeric materials that have suitable organoleptic and or optical properties.

Nonlimiting examples of suitable polymeric materials for the seal layer include olefin-based polymer (including any ethylene/$C_3$-$C_{10}$ α-olefin copolymers linear or branched), propylene-based polymer (including plastomer and elastomer, random propylene copolymer, propylene homopolymer, and propylene impact copolymer), ethylene-based polymer (including plastomer and elastomer, high density polyethylene ("HDPE"), low density polyethylene ("LDPE"), linear low density polyethylene ("LLDPE"), medium density polyethylene ("MDPE"), ethylene-acrylic acid or ethylene-methacrylic acid and their ionomers with zinc, sodium, lithium, potassium, magnesium salts, ethylene vinyl acetate copolymers and blends thereof.

Nonlimiting examples of suitable polymeric material for the outer layer include those used to make biaxially or monoaxially oriented films for lamination as well as coextruded films. Some nonlimiting polymeric material examples are biaxially oriented polyethylene terephthalate (OPET), monoaxially oriented nylon (MON), biaxially oriented nylon (BON), and biaxially oriented polypropylene (BOPP). Other polymeric materials useful in constructing film layers for structural benefit are polypropylenes (such as propylene homopolymer, random propylene copolymer, propylene impact copolymer, thermoplastic polypropylene (TPO) and the like, propylene-based plastomers (e.g., VERSIFY™ or VISTAMAX™)), polyamides (such as Nylon 6, Nylon 6,6, Nylon 6,66, Nylon 6,12, Nylon 12 etc.), polyethylene norbornene, cyclic olefin copolymers, polyacrylonitrile, polyesters, copolyesters (such as PETG), cellulose esters, polyethylene and copolymers of ethylene (e.g., LLDPE based on ethylene octene copolymer such as DOWLEX™, blends thereof, and multilayer combinations thereof.

Nonlimiting examples of suitable polymeric materials for the tie layer include functionalized ethylene-based polymers such as ethylene-vinyl acetate ("EVA"), polymers with maleic anhydride-grafted to polyolefins such as any polyethylene, ethylene-copolymers, or polypropylene, and ethylene acrylate copolymers such an ethylene methyl acrylate ("EMA"), glycidyl containing ethylene copolymers, propylene and ethylene based olefin block copolymers (OBC) such as INTUNE™ (PP-OBC) and INFUSE™ (PE-OBC) both available from The Dow Chemical Company, and blends thereof.

The flexible multilayer film may include additional layers which may contribute to the structural integrity or provide specific properties. The additional layers may be added by direct means or by using appropriate tie layers to the adjacent polymer layers. Polymers which may provide additional mechanical performance such as stiffness or opacity, as well polymers which may offer gas barrier properties or chemical resistance can be added to the structure.

Nonlimiting examples of suitable material for the optional barrier layer include copolymers of vinylidene chloride and methyl acrylate, methyl methacrylate or vinyl chloride (e.g., SARAN resins available from The Dow Chemical Company); vinylethylene vinyl alcohol (EVOH), metal foil (such as aluminum foil). Alternatively, modified polymeric films such as vapor deposited aluminum or silicon oxide on such films as BON, OPET, or OPP, can be used to obtain barrier properties when used in laminate multilayer film.

In an embodiment, the flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), and blends thereof. An optional tie layer is selected from either ethylene-based olefin block copolymer PE-OBC (sold as INFUSE™) or propylene-based olefin block copolymer PP-OBC (sold as INTUNE™). The outer layer includes greater than 50 wt % of resin(s) having a melting point, Tm, that is from 25° C., to 30° C., or 40° C. or higher than the melting point of the polymer in the seal layer wherein the outer layer polymer is selected from resins such as VERSIFY or VISTAMAX, ELITE™, HDPE or a propylene-based polymer such as propylene homopolymer, propylene impact copolymer or TPO.

In an embodiment, the flexible multilayer film is coextruded.

In an embodiment, flexible multilayer film includes a seal layer selected from LLDPE (sold under the trade name DOWLEX™ (The Dow Chemical Company)), single-site LLDPE (substantially linear, or linear, olefin polymers, including polymers sold under the trade name AFFINITY™ or ELITE™ (The Dow Chemical Company) for example, propylene-based plastomers or elastomers such as VERSIFY™ (The Dow Chemical Company), and blends thereof. The flexible multilayer film also includes an outer layer that is a polyamide.

In an embodiment, the flexible multilayer film is a coextruded film, the seal layer is composed of an ethylene-based polymer, such as a linear or a substantially linear polymer, or a single-site catalyzed linear or substantially linear polymer of ethylene and an alpha-olefin monomer such as 1-butene, 1-hexene or 1-octene, having a Tm from 55° C. to 115° C. and a density from 0.865 to 0.925 g/cm$^3$, or from 0.875 to 0.910 g/cm$^3$, or from 0.888 to 0.900 g/cm$^3$ and the outer layer is composed of a polyamide having a Tm from 170° C. to 270° C.

In an embodiment, the flexible multilayer film is a coextruded film having at least five layers, the coextruded film having a seal layer composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$ and an outermost layer composed of a polyamide having a Tm from 170° C. to 270° C.

In an embodiment, the flexible multilayer film is a coextruded film having at least seven layers. The seal layer is composed of an ethylene-based polymer, such as a linear or substantially linear polymer, or a single-site catalyzed linear or substantially linear polymer of ethylene and an alpha-olefin comonomer such as 1-butene, 1-hexene or 1-octene, the ethylene-based polymer having a Tm from 55° C. to 115° C. and density from 0.865 to 0.925 g/cm$^3$, or from 0.875 to 0.910 g/cm$^3$, or from 0.888 to 0.900 g/cm$^3$. The outer layer is a polyamide having a Tm from 170° C. to 270° C.

In an embodiment, the flexible multilayer film includes a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a heat seal initiation temperature (HSIT) from 65° C. to less than 125° C. In a further embodiment, the seal layer of the flexible multilayer film has an HSIT from 65° C., or 70° C., or 75° C., or 80° C., or 85° C., or 90° C., or 95° C., or 100° C. to 105° C., or 110° C., or 115° C., or 120° C., or less than 125° C. Applicant discovered that the seal layer with an ethylene-based polymer with a HSIT from 65° C. to less than 125° C. advantageously enables the formation of secure seals and secure sealed edges around the complex perimeter of the flexible container. The ethylene-based polymer with HSIT from 65° C. to less than 125° C. is a robust sealant which also allows for better sealing to the rigid fitment which is prone to failure. The ethylene-based polymer with HSIT from 65° C. to 125° C. enables lower heat sealing pressure/temperature during container fabrication. Lower heat seal pressure/temperature results in lower stress at the fold points of the gusset, and lower stress at the union of the films in the top segment and in the bottom segment. This improves film integrity by reducing wrinkling during the container fabrication. Reducing stresses at the folds and seams improves the finished container mechanical performance. The low HSIT ethylene-based polymer seals at a temperature below what would cause the outer layer to be compromised.

In an embodiment, the flexible multilayer film is a coextruded five layer film, or a coextruded seven layer film having at least two layers containing an ethylene-based polymer. The ethylene-based polymer may be the same or different in each layer.

In an embodiment, the flexible multilayer film is a coextruded five layer, or a coextruded seven layer film having at least two layers containing a polyamide polymer.

In an embodiment, the flexible multilayer film is a seven-layer coextruded film with a seal layer composed of an ethylene-based polymer, or a linear or substantially linear polymer, or a single-site catalyzed linear or substantially linear polymer of ethylene and an alpha-olefin monomer such as 1-butene, 1-hexene or 1-octene, having a Tm from 90° C. to 104° C. The outer layer is a polyamide having a Tm from 170° C. to 270° C. The film has an inner layer (first inner layer) composed of a second ethylene-based polymer, different than the ethylene-based polymer in the seal layer. The film has an inner layer (second inner layer) composed of a polyamide the same or different to the polyamide in the outer layer. The seven layer film has a thickness from 100 micrometers to 250 micrometers.

Flexible container 10 has an expanded configuration (shown in FIGS. 5-8) and a collapsed configuration as shown in FIG. 9. When the container 10 is in the collapsed configuration, the flexible container is in a flattened, or in an otherwise evacuated state. The gusset panels 18, 20 fold inwardly (dotted lines of FIG. 9) and are sandwiched by the front panel 22 and the rear panel 24.

FIG. 7 shows an enlarged view of the bottom seal area 33 of FIGS. 7 and 9 and the front panel 26*a*. The fold lines 60 and 62 of respective gusset panels 18, 20 are separated by a distance U that is from 0 mm, or 0.5 mm, or 1.0 mm, or 2.0 mm to 12.0 mm, or 60 mm, or greater than 60 mm. In an embodiment, distance U varies based on the size and volume of the flexible container 10. For example, the flexible container 10 may have a distance U (in mm) that is from greater than 0 mm to three times the volume (in liters) of the container. For example, a 2-liter flexible container can have a distance U from greater than 0 to less than or equal to 6.0 mm. In another example, a 20-liter flexible container 10 has a distance U that is from greater than 0 mm to less than or equal to 60 mm.

FIG. 7 shows line A (defined by inner edge 29*a*) intersecting line B (defined by inner edge 29*b*) at apex point 35*a*. BDISP 37*a* is on the distal inner seal arc 39*a*. Apex point 35*a* is separated from BDISP 37*a* by distance S having a length from greater than 0 mm, or 1.0 mm, or 2.0 mm, or 2.6 mm, or 3.0 mm, or 3.5 mm, or 3.9 mm to 4.0 mm, or 4.5 mm, or 5.0 mm, or 5.2 mm, or 5.5 mm, or 6.0 mm, or 6.5 mm, or 7.0 mm, or 7.5 mm, or 7.9 mm.

In FIG. 7, an overseal 64 is formed where the four peripheral tapered seals 40*a*-40*d* converge in the bottom seal area. The overseal 64 includes 4-ply portions 66, where a portion of each panel (18, 20, 22, 24) is heat sealed to a portion of every other panel. Each panel represents 1-ply in the 4-ply heat seal. The overseal 64 also includes a 2-ply portion 68 where two panels (front panel 22 and rear panel 24) are sealed together. Consequently, the "overseal," as used herein, is the area where the peripheral tapered seals converge and that is subjected to a subsequent heat seal operation (and subjected to at least two heat seal operations altogether). The overseal 64 is located in the peripheral tapered seals and does not extend into the chamber of the flexible container 10. Each panel 18, 20, 22, 24 extends from the bottom seal area 33 to the neck 27, each panel sealed to the spout 30. In an embodiment, each panel 18, 20, 22, 24 extends from the overseal 64 to the neck 27, each panel sealed to the spout 30.

In an embodiment, the apex point 35*a* is located above the overseal 64. The apex point 35*a* is separated from, and does not contact the overseal 64. The BDISP 37*a* is located above the overseal 64. The BDISP 37*a* is separated from and does not contact the overseal 64.

In an embodiment, the apex point 35*a* is located between the BDISP 37*a* and the overseal 64, wherein the overseal 64 does not contact the apex point 35*a* and the overseal 64 does not contact the BDISP 37*a*.

The distance between the apex point 35*a* to the top edge of the overseal 64 is defined as distance W shown in FIG. 7. In an embodiment, the distance W has a length from 0 mm, or greater than 0 mm, or 2.0 mm, or 4.0 mm to 6.0 mm, or 8.0 mm, or 10.0 mm or 15.0 mm.

When more than four webs are used to produce the container, the portion 68 of the overseal 64 may be a 4-ply, or a 6-ply, or an 8-ply portion.

The gusseted side panels 18, 20 adjoin the front panel 22 and the rear panel 24 along peripheral seals to form a chamber.

Each peripheral seal has (i) an arcuate body seal inner edge (ABSIE) with opposing ends. (ii) A tapered seal inner edge (TSIE) extends from each end of the body seal. (C) The flexible container comprises at least one ABSIE having a radius of curvature, Rc, from 1.0 mm, or 3.0 mm, or 5.0 mm, or 7.0 mm, or 8.0 mm, or 8.5 mm, or 9.0 mm, or 9.5 mm, or 10.0 mm, or 10.5 mm, or 11.0 mm, or 13.0 mm, or 15.0 mm, or 20.0 mm, or 25.0 mm, or 50.0 mm, or 75.0 mm, or 100.0 mm to 150.0 mm, or 200.0 mm, or 250.0 mm, or 300.0 mm.

In an embodiment, a corner arc is present between each ABSIE and TSIE.

Figure 10:
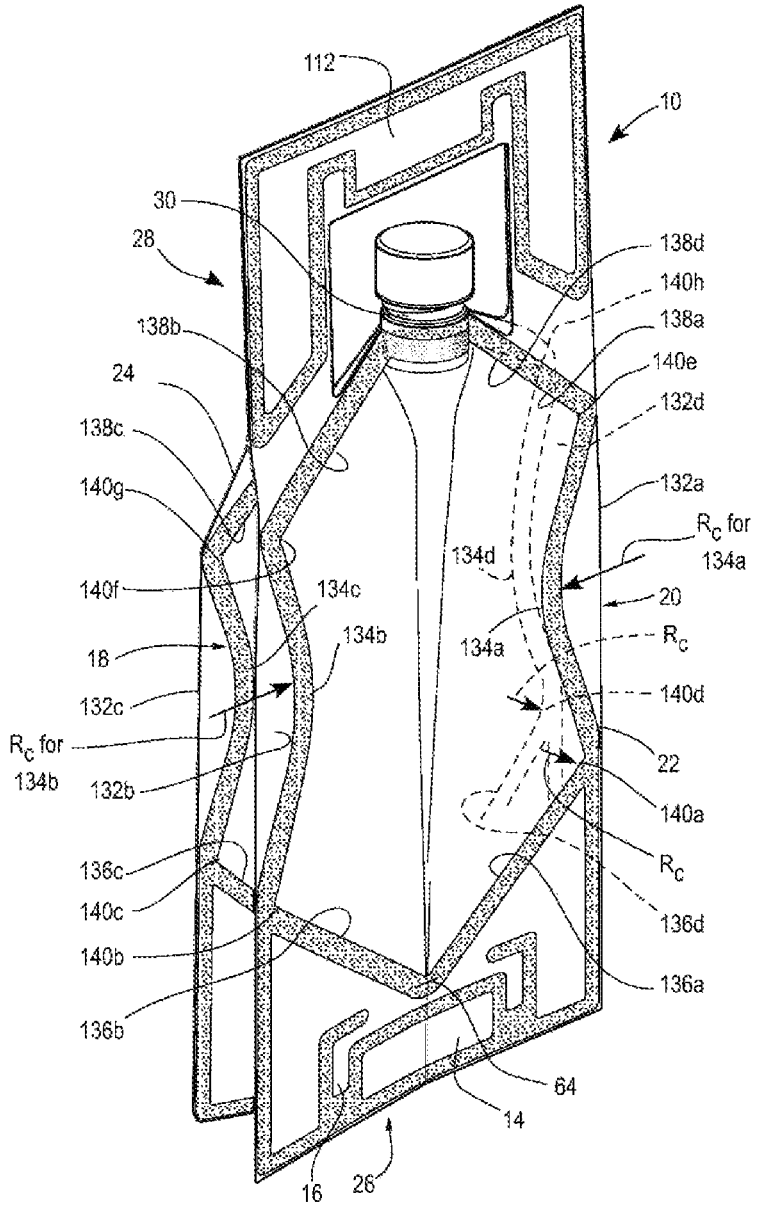
FIG. 10 is a perspective view of the flexible container of FIG. 9, partially expanded to show the body seal inner edges.

The peripheral seals 41 shown in FIG. 5 are described in further detail in FIGS. 9 and 10. In FIGS. 9 and 10, the peripheral seals 41 of FIG. 5 are identified individually as peripheral seals 132*a*, 132*b*, 132*c*, and 132*d*. Each peripheral seal 132*a*-132*d* has opposing ends, a top end and a bottom end. Each peripheral seal 132*a*-132*d* includes a respective arcuate body seal inner edge (ABSIE) 134*a*, 134*b*, 134*c*, and 134*d*. Each peripheral seal 132*a*-132*d* further includes a respective tapered seal inner edge (TSIE) extending from the bottom end and from the top end of each respective ABSIE. TSIEs 136*a*, 136*b*, 136*c*, 136*d* extend from the bottom end of each respective ABSIE 134*a*-134*d* and are hereafter collectively referred to as "b-TSIE." TSIEs 138*a*, 138*b*, 138*c*, and 138*d* extend from the top end of each respective ABSIE and are hereafter collectively referred to as "t-TSIE."

A corner arc 140*a*-140*h* (or "CA 140*a*-140*h*") extends between each ABSIE and TSIE to connect, or otherwise adjoin, each TSIE to its respective ABSIE end (top end or bottom end). The flexible container 10 has eight corner arcs (or CAs), 140*a*-140*h*. As best shown in FIG. 9, CA 140*a* extends between BSIE 134*a* and *b*-TSIE 136*a*. CA 140*a* connects BSIE 134*a* to *b*-TSIE 136*a*. It is understood that CAs 140*b*-140*h* connect respective ABSIEs and TSIEs in a similar manner as shown and described with respect to CA 140*a*. It is further understood that corner arcs 140*a*-140*h* are distinct from the distal inner seal arcs 39*a*, 39*c* in the bottom seal area.

The "radius of curvature," or "Rc," as used herein, is the radius of a circular arc which best approximates the curve at a given point. The radius of curvature is measured when the flexible container 10 is in its collapsed configuration.

The flexible container 10 has ABSIEs 134*a*-134*d*. Each ABSIE 134*a*-134*d* has a radius of curvature from 1.0 mm, or 3.0 mm, or 5.0 mm, or 7.0 mm, or 8.0 mm, or 8.5 mm, or 9.0 mm, or 9.5 mm, or 10.0 mm, or 10.5 mm, or 11.0 mm, or 13.0 mm, or 15.0 mm, or 20.0 mm, or 25.0 mm, or 50.0 mm, or 75.0 mm, or 100.0 mm to 150.0 mm, or 200.0 mm, or 250.0 mm, or 300.0 mm. The Rc for each ABSIE 134*a*-134*d* may be the same or may be different. In an embodiment, the Rc for each ABSIE 134*a*-134*d* is the same.

Figure 11:
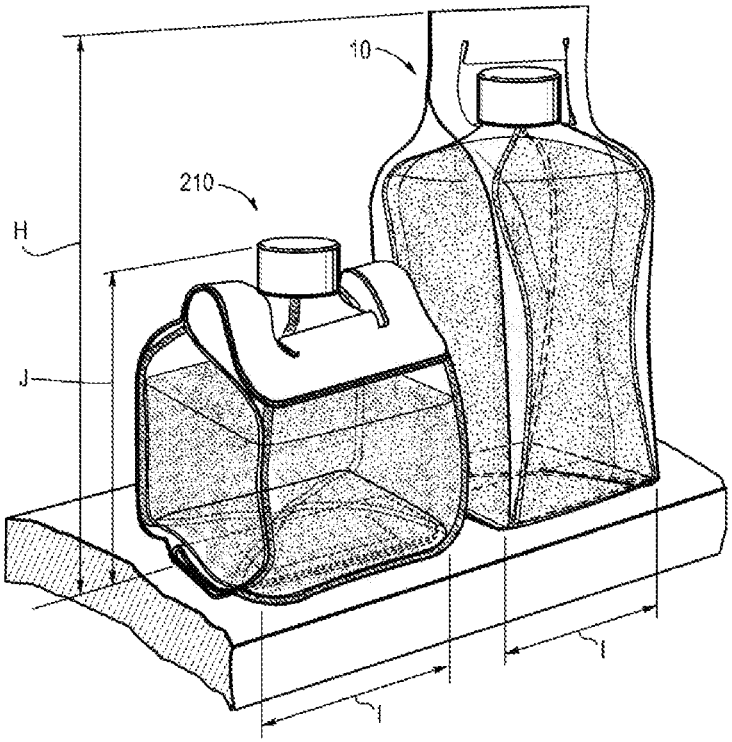
FIG. 11 is a perspective view of the filled flexible container of FIG. 5 next to a conventional filled flexible container.

In an embodiment, the flexible container 10 has an aspect ratio. The "aspect ratio of the flexible container" (aspect ratio-FC), as used herein, is the height of the flexible container divided by the width of the flexible container. The aspect ratio-FC is measured when the flexible container is in an expanded and stand-up configuration (when the container is filled with product, for example) as shown in FIG. 11. In FIG. 11, flexible container 10 is in the expanded and stand-up position. Distance H is the height of the flexible container 10 and distance I is the width of the flexible container 10. The aspect ratio-FC is distance H divided by distance I.

In an embodiment, the aspect ratio-FC is from 1:1, or 1.2:1, or 1.2:1, or 1.5:1, or 2.0:1, or 2.5:1 to 3.0:1, or 3.2:1, or 3.4:1, or 3.6:1, or 3.8:1. In a further embodiment, the aspect ratio-FC is from 1:1 to 3.8:1, or from 1.5:1 to 3.6:1, or 2.5:1 to 3.2:1.

In an embodiment, the flexible container 10 has a volume from 0.25 liters (L), or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

FIGS. 9 and 11 show an embodiment wherein flexible container 10 has ABSIEs 134*a*-134*d* and each ABSIE has the same Rc, and the Rc is from 1.0 mm, or 3.0 mm, or 5.0 mm, or 7.0 mm, or 8.0 mm, or 8.5 mm, or 9.0 mm, or 9.5 mm, or 10.0 mm, or 10.5 mm, or 11.0 mm, or 13.0 mm, or 15.0 mm, or 20.0 mm, or 25.0 mm, or 50.0 mm, or 75.0 mm, or 100.0 mm to 150.0 mm, or 200.0 mm, or 250.0 mm, or 300.0 mm. Flexible container 10 has an aspect ratio-FC from 1.2:1 to 3.0:1. In a further embodiment, the flexible container 10 has a volume from 1 liter (L), or 2 L, or 3 L, or 3.78 L, or 4 L, or 5 L or 10 L to 20 L, or 25 L, or 30 L.

Flexible container 10 with ABSIEs 134*a*-134*d* exhibits a greater aspect ratio compared to the aspect ratio of a similar prior art four panel stand-up flexible container. For the purposes of the present disclosure the similar prior art four panel stand-up flexible container is termed a conventional flexible container (CFC), at 210 in FIG. 11 CFC 210 has a width I that is the same length as the width I of flexible container 10. CFC 210 has a height J that is less than the height H of flexible container 10. The aspect ratio-FC of flexible container 10 is greater than the aspect ratio J/I of CFC 210. The shape of flexible container 10 is more similar to a cuboid when compared to the shape of CFC 210. In other word, flexible container 10 is more elongated when compared to CFC 210.

Returning to FIG. 5, FIG. 5 shows an embodiment wherein each ABSIE 134*a*-134*d* has a respective peak arc point 150*a*, 150*b*, 150*c*, and 150*d*. A Plane L extends through all four of the peak arc points 150*a*-150*d*. In an embodiment, the Plane L defines a center interface of the flexible container 10. The chamber volume (when flexible container 10 is in the expanded configuration) from the bottom segment 26 to the Plane L and bounded by panels 18-24 defines a lower container volume. The lower container volume is greater than 50% of the total volume of the flexible container 10. In this way, Plane L defines a lower container volume that is greater than 50% of the total volume to the flexible container 10.

In an embodiment, the lower container volume is from 51%, or 53% or 55% to 57% or 59%, or 60% of the total volume of flexible container 10.

The flexible container 10 can be used to store any number of flowable substances therein. In particular, a flowable food product can be stored within the flexible container 10. In one aspect, flowable food products such as salad dressings, sauces, dairy products, mayonnaise, mustard, ketchup, other condiments, beverages such as water, juice, milk, or syrup, carbonated beverages, beer, wine, animal feed, pet feed, and the like can be stored inside of the flexible container 10.

The flexible container 10 is suitable for storage of other flowable substances including, but not limited to, oil, paint, grease, chemicals, cleaning solutions, washing fluids, suspensions of solids in liquid, and solid particulate matter (powders, grains, granular solids).

The flexible container 10 is suitable for storage of flowable substances with higher viscosity and requiring application of a squeezing force to the container in order to discharge. Nonlimiting examples of such squeezable and flowable substances include grease, butter, margarine, soap, shampoo, animal feed, sauces, and baby food.

By way of example, and not by limitation, some embodiments of the present disclosure will now be described in detail in the following Examples.

B. Box

Figure 3B:
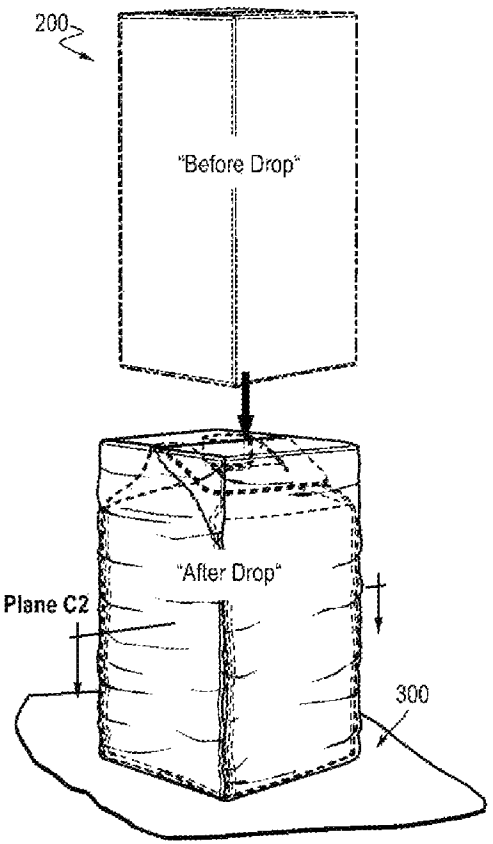
FIG. 3BB is a perspective view of the conventional bag-in-box assembly of FIG. 2 undergoing a one meter drop test.
Figure 3A:
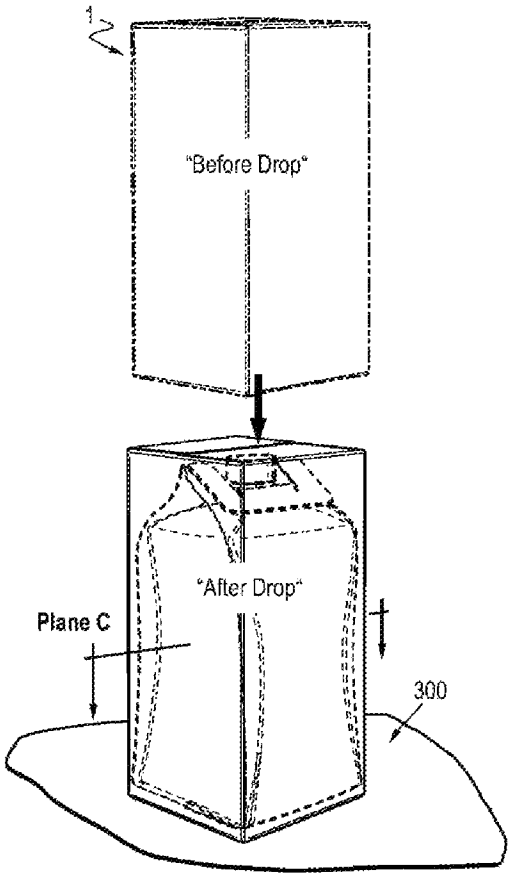
FIG. 3AA is a perspective view of the bag-in-box assembly of FIG. 1 undergoing a one meter drop test in accordance with an embodiment of the present disclosure.
Figure 3A:
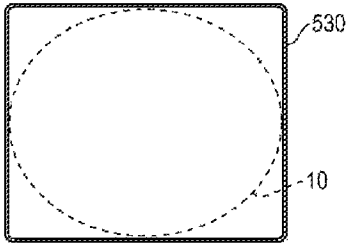
Figure 3B:
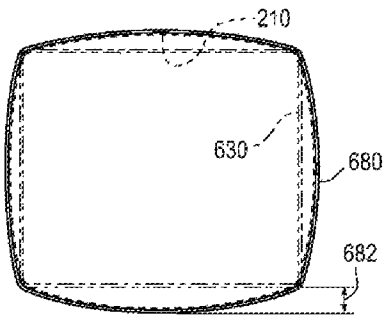

The bag-in-box assembly as provided by the present disclosure includes a box, such as box 420 shown in FIGS. 1, 3AA and 4. The box 420 has a geometric shape. A "geometric shape," as used herein, is a three dimensional shape or a three dimensional configuration having a height, a length, and a width. Generally, the height, the length, and the width are measured at a base of the geometric shape. The geometric shape can be a regular three dimensional shape, an irregular three dimensional shape, and combinations thereof. Nonlimiting examples of regular three-dimensional shapes include cube, cuboid, prism, triangular pyramid, square pyramid, sphere, cone, and cylinder. Nonlimiting examples of irregular three-dimensional shapes include truncated prism, truncated triangular pyramid, truncated square pyramid and truncated cone. In an embodiment, the height of a truncated three-dimensional shape is less than the height of the corresponding regular three-dimensional shape. It is understood that when the geometric shape of the box is a prism, the prism can have a cross-sectional shape that is a regular polygon, or an irregular polygon, having three, four, five, six, seven, eight, nine, ten or more sides.

Returning to FIG. 1, the box 420 includes a top wall 430, a bottom wall 432, and has from three or four, to five or six, or seven to eight, or more side walls 434. The side walls 434 extend between the top wall 430 and the bottom wall 432, the walls 430-434 forming a compartment 426. The flexible container 10 is located within the compartment 426.

In an embodiment, the box 420 is a cuboid having the top wall 430, the bottom wall 432 and four side walls 434.

In an embodiment, the top wall 430 and/or the bottom wall 432 has one, two, or more flaps attached to respective one, two, or more side walls 434.

The box 420 can be openable from the top wall 430, the bottom wall 432, or a side wall 434. In an embodiment, the box 420 is openable by way of the top wall 430.

The box 420 is openable and closable between an open configuration and a closed configuration. An "open configuration" is an arrangement of the walls 430-434 that allows access to the compartment. A "closed configuration" is an arrangement of the walls 430-434 preventing, or otherwise denying, access to the compartment 426. When the box 420 is in the closed configuration, the walls 430-434 form a completely enclosed compartment.

The box 420 has an inner surface and an outer surface. The inner surface is defined by the portions of the walls 430-434 that form and are located adjacent to compartment 426. For the purposes of the present disclosure, the portions of the side walls 434 that define the inner surface of the box are termed the "inner side walls." The outer surface is the exterior surface of the box 420.

The box 420 has an aspect ratio. The "aspect ratio of the box" (or "aspect ratio-B"), as used herein, is the height of the box divided by the width of the box. The aspect ratio-B is measured when the flexible container 10 is in a filled state and occupies the box 420. Returning to FIG. 1, distance $H_B$ is the height of the box 420 and distance $W_B$ is the width of the box 420. The aspect ratio-B is distance $H_B$ divided by distance $W_B$.

In an embodiment, the aspect ratio-B is from 1.1:1, or 1.3:1, or 1.3:1, or 1.7:1, or 2.2:1, to 2.7:1, or 3.3:1, or 3.5:1, or 3.7:1, or 3.9:1, or 4.1:1. In a further embodiment, the aspect ratio-B is from 1.1:1 to 4.1:1, or from 1.7:1 to 3.7:1, or from 2.7:1 to 3.3:1.

The walls 430-434 are made of a rigid material. Nonlimiting examples of suitable material for the walls include cardboard, polymeric material, metal, wood, fiberglass, and any combination thereof.

In an embodiment, the box 420 has the top wall 430, the bottom wall 432 and the side walls 434, the walls 430-434 are made from corrugated cardboard. The corrugated cardboard has a wall width from 1.6 mm to 5.6 mm, or from 2.4 mm to 4.0 mm. In a further embodiment, the corrugated cardboard has a wall width from 2.4 mm to 3.2 mm.

C. Assembly

Returning to FIG. 1, the BIB assembly 1 includes a top perimeter 510, a center perimeter 530 and a bottom perimeter 550. The top perimeter 510, the center perimeter 530 and the bottom perimeter 550 are illustrated further in FIGS. 1A, 1B and 1C, respectively. "Top perimeter 510," as used herein, is the circumference of the inner side walls 434 defined by Plane T (shown in FIG. 1), Plane T containing, or otherwise traversing, the box 420 and the flexible container 10. Plane T is located from 0.5 to 4 cm, or from 1.2 to 3 cm, or from 1.6 to 2.5 cm below the center arcs 140*e*-140*h* of filled flexible container 10 as shown in FIGS. 9 and 10. "Center perimeter 530," as used herein, is the circumference of the inner side walls 434 defined by Plane C (shown in FIG. 1), Plane C containing, or otherwise traversing, (i) the box 420 and (ii) the flexible container 10, Plane C also including (iii) a midpoint height of the flexible container 10. In an embodiment, Plane C is Plane L of FIG. 5, as described herein. "Bottom perimeter 550," as used herein, is the circumference of the inner side walls 434 defined by Plane B (shown in FIG. 1), Plane B containing, or otherwise traversing, the box 420 and the flexible container 10. Plane B is located from 0.5 to 4 cm, or from 1.2 to 3 cm, or from 1.6 to 2.5 cm above the lowermost surface of the flexible container 10.

Figure 1A:
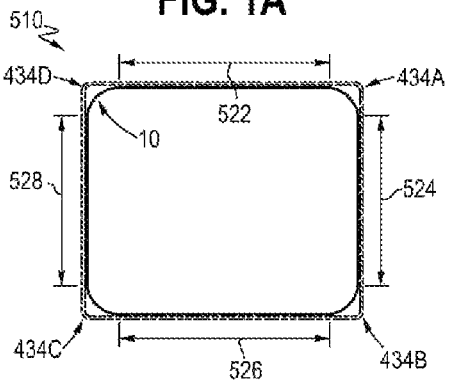
FIG. 1A is a cross-sectional view taken at Plane T of FIG. 1 of a top perimeter of the bag-in-box assembly of FIG. 1 in accordance with an embodiment of the present disclosure.

Referring to FIG. 1A, a cross-sectional view of the top perimeter 510 is shown. Top perimeter 510 has a length equal to the sum of the lengths of the inner side walls 434A, 434B, 434C and 434D. The top perimeter 510 includes contact lengths 522, 524, 526 and 528. A "contact length," as used herein, is the extent of touch between an outer surface of the flexible container and an inner side wall as measured along a single perimeter (i.e., top perimeter 510, or center perimeter 530, or bottom perimeter 550). In other words, the contact length is a linear interface of the outer surface of the flexible container and an inner side wall as measured along one of the perimeters (i.e., top perimeter 510, or center perimeter 530, or bottom perimeter 550). Contact length 522 extends along the outer surface of the flexible container 10 and also along the inner side wall 434A. Contact lengths 524, 526 and 528 extend along the outer surface of the flexible container 10 and also along the inner side walls 434B, 434C and 434D, respectively.

Figure 1B:
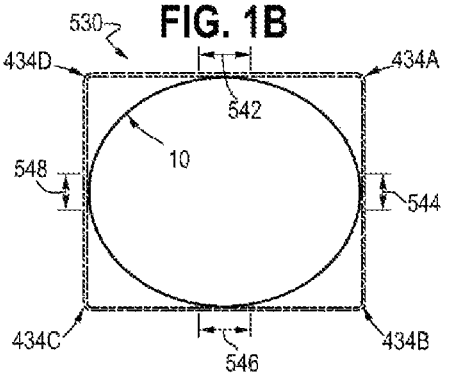
FIG. 1B is a cross-sectional view taken at Plane C of FIG. 1 of a center perimeter of the bag-in-box assembly of FIG. 1 in accordance with an embodiment of the present disclosure.

Referring to FIG. 1B, a cross-sectional view of the center perimeter 530 is shown. Center perimeter 530 has a length equal to the length of the top perimeter 510. The center perimeter 530 includes contact lengths 542, 544, 546 and 548. Contact length 542 extends along the outer surface of the flexible container 10 and also along the inner side wall 434A. Contact lengths 544, 546 and 548 extend along the outer surface of the flexible container 10 and also along the inner side walls 434B, 434C and 434D, respectively.

Figure 1C:
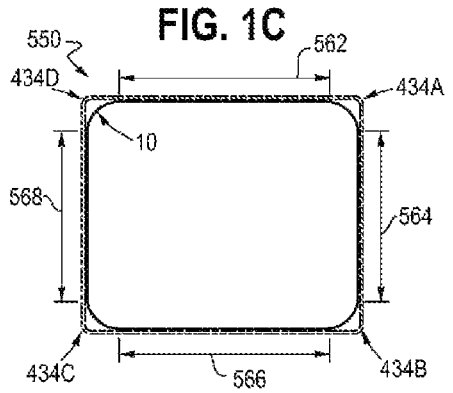
FIG. 1C is a cross-sectional view taken at Plane B of FIG. 1 of a bottom perimeter of the bag-in-box assembly of FIG. 1 in accordance with an embodiment of the present disclosure.

Referring to FIG. 1C, a cross-sectional view of the bottom perimeter 550 is shown. Bottom perimeter 550 has a length equal to the length of the top perimeter 510. The bottom perimeter 550 includes contact lengths 562, 564, 566 and 568. Contact length 562 extends along the outer surface of the flexible container 10 and the inner side wall 434A. Contact lengths 564, 566 and 568 extend along the outer surface of the flexible container 10 and the inner side walls 434B, 434C and 434D, respectively.

An "aggregate contact length" (or "ACL"), as used herein, is the sum of the contact lengths contained within a single perimeter (i.e., top perimeter 510, or center perimeter 530, or bottom perimeter 550). The top perimeter 510 includes a top ACL, the top ACL being the sum of the contact lengths 522, 524, 526 and 528. The top ACL is determined when a volume of the flexible container 10 containing a flowable substance is from 70%, or 75%, or 80% to 85%, or 90%, or 95%, or 98% of a total volume of the flexible container 10. In an embodiment, the top ACL is determined when a volume of the flexible container 10 containing a flowable substance is from 70% to 98%, or from 80% to 95%, or from 85% to 90% of the total volume of the flexible container 10. The top ACL is from 50%, or 55%, or 60%, or 65% to 70%, or 75%, or 80%, or 85%, or 90% of the top perimeter 510. In an embodiment, the top ACL is from 50% to 90%, or from 63% to 86%, or from 76% to 83% of the top perimeter 510.

The center perimeter 530 includes a center ACL, the center ACL being the sum of the contact lengths 542, 544, 546 and 548. The center ACL determined when a volume of the flexible container 10 containing a flowable substance is from 70%, or 75%, or 80% to 85%, or 90%, or 95%, or 98% of a total volume of the flexible container 10. In an embodiment, the center ACL is determined when a volume of the flexible container 10 containing a flowable substance is from 70% to 98%, or from 80% to 95%, or from 85% to 90% of a total volume of the flexible container 10. The center ACL is from 5%, or 10%, or 15%, or 20%, or 25% to 30%, or 35%, or 40%, or 45%, or 50% of the center perimeter 530. In an embodiment, the center ACL is from 5% to 50%, or from 10% to 35%, or from 17% to 25% of the center perimeter 530.

The bottom perimeter 550 includes a bottom ACL, the bottom ACL being the sum of the contact lengths 562, 564, 566 and 568. The bottom ACL is determined when a volume of the flexible container 10 containing a flowable substance is from 70%, or 75%, or 80% to 85%, or 90%, or 95%, or 98% of a total volume of the flexible container 10. In an embodiment, the bottom ACL is determined when a volume of the flexible container 10 containing a flowable substance is from 70% to 98%, or from 80% to 95%, or from 85% to 90% of a total volume of the flexible container 10. The bottom ACL is from 50%, or 55%, or 60%, or 65% to 70%, or 75%, or 80%, or 85%, or 90% of the bottom perimeter 550. In an embodiment, the bottom ACL is from 50% to 90%, or from 63% to 86%, or from 76% to 83% of the bottom perimeter 550.

Referring to FIG. 2, a conventional assembly (CVA) is indicated by the reference numeral 200. The CVA 200 includes a conventional box (CB) 220 and a conventional flexible container (CFC) 210. CB 220 is a cuboid having a top wall 230, a bottom wall 232 and four side walls 234. The four side walls 234 extend between the top wall 230 and the bottom wall 232, the walls 230-234 forming a compartment 226. The CFC 210 is located in the compartment 226, the entire outer surface of the CFC 210 resting against an inner surface of the side walls 234.

The CVA 200 includes a top perimeter 610, a center perimeter 630 and a bottom perimeter 650. "Top perimeter 610", as used herein, is the circumference of the inner side walls of the CB 220 defined by Plane T2 (shown in FIG. 2), Plane T2 containing, or otherwise traversing, the CB 220 and the CFC 210. Plane T2 is located from 0.5 to 5 cm, or from 1 cm to 3 cm below an uppermost surface of the flowable material. "Center perimeter 630", as used herein, is the circumference of the of the inner side walls of the CB 220 defined by Plane C2 (shown in FIG. 2), Plane C2 containing, or otherwise traversing, (i) the CB 220 and (ii) the CFC 210, Plane C2 also including (iii) a midpoint height of the CFC 210. "Bottom perimeter 650", as used herein, is the circumference of the inner side walls of the CB 220 defined by Plane B2 (shown in FIG. 2), Plane B2 containing, or otherwise traversing, the CB 200 and the CFC 210. Plane B2 is located from 0.5 to 4 cm, or from 1.2 to 3 cm above the lowermost surface of the CFC 210.

Figure 2A:
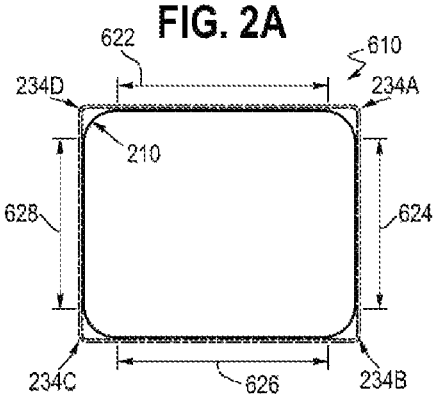
FIG. 2A is a cross-sectional view taken at Plane T2 of FIG. 2 of a top perimeter of the conventional bag-in-box assembly of FIG. 2.

Referring to FIG. 2A, a cross-sectional view of the top perimeter 610 is shown. Top perimeter 610 has a length equal to the sum of the lengths of the inner side walls 234A, 234B, 234C and 234D. The top perimeter 610 includes contact lengths 622, 624, 626 and 628. Contact length 622 extends along the outer surface of the CFC 210 and the inner side wall 234A. Contact lengths 624, 626 and 628 extend along the outer surface of the CFC 210 and the inner side walls 234B, 234C and 234D, respectively.

Figure 2B:
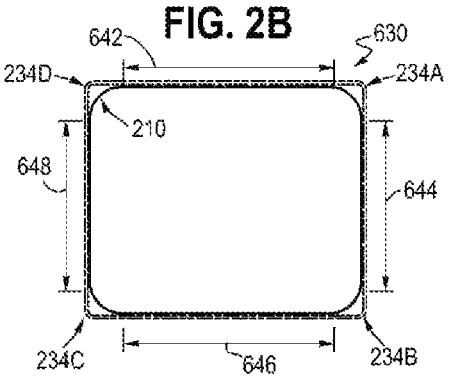
FIG. 2B is a cross-sectional view taken at Plane C2 of FIG. 2 of a center perimeter of the conventional bag-in-box assembly of FIG. 2.

Referring to FIG. 2B, a cross-sectional view of the center perimeter 630 is shown. Center perimeter 630 has a length equal to the length of the top perimeter 610. The center perimeter 630 includes contact lengths 642, 644, 646 and 648. Contact length 642 extends along the outer surface of the CFC 210 and the inner side wall 234A. Contact lengths 644, 656 and 648 extend along the outer surface of the CFC 210 and the inner side walls 234B, 234C and 234D, respectively.

Figure 2C:
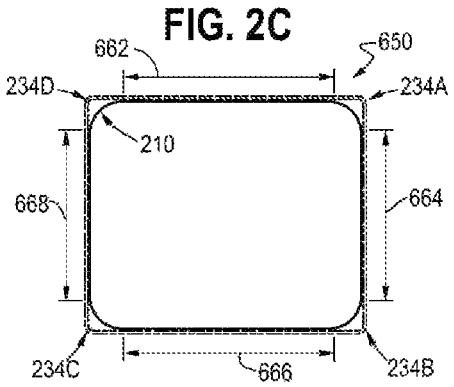
FIG. 2C is a cross-sectional view taken at Plane B2 of FIG. 2 of a bottom perimeter of the conventional bag-in-box assembly of FIG. 2.

Referring to FIG. 2C, a cross-sectional view of the bottom perimeter 650 is shown. Bottom perimeter 650 has a length equal to the length of the top perimeter 610. The bottom perimeter 650 includes contact lengths 662, 664, 666 and 668. Contact length 662 extends along the outer surface of the CFC 210 and the inner side wall 234A. Contact lengths 664, 666 and 668 extend along the outer surface of the CFC 210 and the inner side walls 234B, 234C and 234D, respectively.

The top perimeter 610 includes a top conventional aggregate contact length (ACL-C), the top ACL-C being the sum of the contact lengths 622, 624, 626 and 628. The center perimeter 630 includes a center ACL-C, the center ACL-C being the sum of the contact lengths 642, 644, 646 and 648. The bottom perimeter 650 includes a bottom ACL-C, the bottom ACL-C being the sum of the contact lengths 662, 664, 666 and 668. The length of the center ACL-C is from 97% to 100% of the length of the center perimeter 630 as disclosed herein. The length of the top ACL-C is from 97% to 100% of (i) the length of the center ACL-C or (ii) the length of the bottom ACL-C. The length of the center ACL-C is from 97% to 100% of the length of the bottom ACL-C. The lengths of the top ACL-C, the center ACL-C and the bottom ACL-C are measured when from 95% to 100% of the total volume of the CFC 210 contains a flowable substance.

Referring to FIGS. 3AA and 3BB, the bag-in-box (BIB) assembly 1 and the conventional assembly (CVA) 200 are shown before being subjected to a one meter drop test. The one meter drop test is conducted in accordance with the test method described herein. The test method includes methods for measuring the surface distortion of the bag-in-box assemblies and for dropping the bag-in-box assemblies onto a concrete flat surface 300. The lower portion of FIGS. 3AA and 3BB (annotated as "After-Drop"), illustrates the assemblies after the one meter drop test.

FIG. 3A is a cross-sectional view at Plane C of the center perimeter 530 of the BIB assembly 1 of FIG. 3AA after the one meter drop test. The center perimeter 530 and the flexible container 10 are unchanged by the one meter drop test. The shape and size of the exterior surface of the BIB assembly 1 are the same before and after the one meter drop test. The shape and size of the outermost surface of the flexible container 10 are the same before and after the one meter drop test.

FIG. 3B is a cross-sectional view at Plane C2 of the center perimeter the CVA 200 of FIG. 3BB. Center perimeters of the CVA 200 before and after the one meter drop test are shown at 630 and 680, respectively. Comparison of the center perimeters 630 (pre-drop) and 680 (post-drop) shows that the shape and size of center perimeter 680 (post-drop) is greater than center perimeter 630 (pre-drop). FIG. 3B shows that CVA 200 experiences box bulge as a result of the one meter drop test. "Box bulge," as used herein, refers to an increase in size, and/or an increase in width, and/or an increase in volume exhibited by one, some, or all of the walls of the box, or the box as a whole, after being subjected to a one meter drop test.

Figure 4:
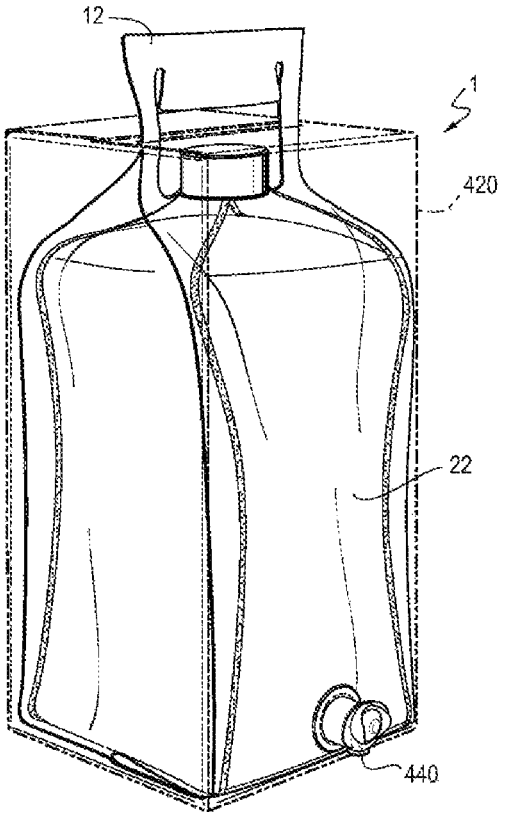
FIG. 4 is a perspective view of a bag-in-box assembly with a tap in accordance with an embodiment of the present disclosure.

Referring to FIG. 4, an embodiment of the BIB assembly 1 has a tap 440 attached to a front panel 22 wherein the tap 440 is in fluid communication with a chamber of the flexible container 10. In an embodiment, the box 420 further has an opening through which a portion of the tap 440 extends, the box 420 being configured to house the tap 440. The tap can be actuated to dispense the flowable material within the BIB assembly 1. In a further embodiment, a handle 12 extends through the top wall 430.

A BIB assembly of the present disclosure provides a billboard area, the billboard area having from 355 $cm^2$ to 645 $cm^2$. In an embodiment the billboard area has from 355 $cm^2$ to 387 $cm^2$ when the volume of the flexible container 10 is from 3.7 L to 3.9 L.

In an embodiment, the BIB assembly of the present disclosure provides a box 420 having one or more cutouts. A "cutout", as used herein, is an area of the box that has been removed and provides a view of the flexible container and the contents thereof. In an embodiment, the cutouts display the flowable material within the flexible container 10 creating graphic advertisement thereby. The graphic advertisement of the cutouts can be advantageous when compared to a conventional assembly (CVA) 200 comprising a box that cannot feature cutouts, i.e., the entire surface area of a conventional box 220 is required to provide mechanical support to the CVA 200.

In an embodiment, a BIB assembly of the present disclosure provides a box 420 having a wall width of from 2.4 mm to 3.0 mm. The present BIB assembly is advantageous when compared to a conventional assembly (CVA) 200 utilizing a conventional box 220 having a wall width greater than 3.0 mm, e.g., the weight of the present BIB assembly 1 is less than the weight of the CVA 200. Reduced weight provides lowered manufacturing and transportation costs for the BIB assembly 1 when compared to the CVA 200.

In an embodiment, the BIB assembly 1 of the present disclosure has an aspect ratio equal to the aspect ratio of the box 420 (aspect ratio-B). The aspect ratio of the BIB assembly is greater than an aspect ratio of the conventional assembly (CVA) 200 as described herein. The aspect ratio of the BIB assembly is greater than an aspect ratio of the conventional flexible container (CFC) 210 as described herein.

By way of example, and not by limitation, some embodiments of the disclosure will now be described in detail in the following Examples.

EXAMPLES

Four bag-in-box (BIB) assemblies (comparative sample 1, comparative sample 2, inventive example 1, inventive example 2) are produced with the respective dimensions provided in Table 1 below. The box measurements listed are exterior dimensions of the BIB assembly. Paper corrugate with a nominal thickness of 3.2 mm (⅛ in) is used to form all boxes in the following examples. The box shapes are secured using masking tape of 2.54 cm (1 in) width at the points of corrugate overlap.

TABLE 1

| | Filled volume (L) | Flexible Container ID | Box Dimensions Length (cm [in]) | Width (cm [in]) | Height (cm [in]) |
|---|---|---|---|---|---|
| Comparative Sample 1 | 3.8 | CFC 210<br>Top ACL: 47.6-58.0 cm<br>Center Top ACL: 47.6-58.0 cm<br>Bottom Top ACL: 47.6-58.0 cm | 16.5 [6.50] | 16.5 [6.50] | 21.6 [8.50] |
| Comparative Sample 2 | 10 | CFC 210<br>Top ACL: 59.2-72.4 cm<br>Center Top ACL: 59.2-72.4 cm<br>Bottom Top ACL: 59.2-72.4 cm | 23.5 [9.25] | 23.5 [9.25] | 26.0 [10.25] |
| Example 1 | 3.8 | Flexible Container 10<br>Top ACL: 47.6-58.0 cm<br>Center Top ACL: 8.4-11.4 cm<br>Bottom Top ACL: 47.6-58.0 cm | 16.5 [6.50] | 16.5 [6.50] | 22.2 [8.75] |
| Example 2 | 10 | Flexible Container 10<br>Top ACL: 59.2-72.4 cm<br>Center Top ACL: 9.6-12.7 cm<br>Bottom Top ACL: 59.2-72.4 cm | 23.5 [9.25] | 23.5 [9.25] | 27.3 [10.75] |

The flexible containers are filled with ambient temperature water and placed in the corresponding boxes to form the assemblies. No additional weight or bracing is added to the box.

The pre-drop distortion is measured for each assembly as described in Drop Test Method A. No pre-drop distortion is observed for any of the assemblies as listed in Table 2.

The assemblies are dropped and the post-drop distortion is measured for each assembly. The box bulge (i.e., drop-related distortion) corresponding to length 682 of FIG. 3B is then calculated according to Drop Test Method A.

Table 2 shows that the conventional assemblies (comparative samples 1 and 2), experienced box bulge, (i.e., the dimensions of the box changed). Box bulge for comparative sample 1 with a 3.8 L volume is 0.63 mm. Box bulge for comparative sample 2 with a 10 L volume is 1.3 mm. Box bulge equals zero for inventive example 1 and for inventive example 2. No box bulge is observed at any side of a box for inventive example 1 and for inventive example 2, indicating that the shape of the box is unaltered from the original state.

TABLE 2

| | Maximum curve of side seal (cm [in]) | Width of empty flexible container (cm [in]) | Box Bulge Measured Pre-drop distortion (cm [in]) | Post-drop distortion (cm [in]) |
|---|---|---|---|---|
| Comparative Sample - 1 | 0 [0] | 16.5 [6.50] | 0 [0] | 0.63 [1/4] |
| Comparative Sample - 2 | 0 [0] | 23.5 [9.25] | 0 [0] | 1.3 [1/2] |
| Example - 1 | 0.95 [3/8] | 16.5 [6.50] | 0 [0] | 0 [0] |
| Example - 2 | 0.95 [3/8] | 23.5 [9.25] | 0 [0] | 0 [0] |

It is specifically intended that the present disclosure not be limited to the embodiments and illustrations contained herein, but include modified forms of those embodiments including portions of the embodiments and combinations of elements of different embodiments as come with the scope of the following claims.

What is claimed is:

1. A bag-in-box assembly comprising:

a box having an inner surface, the inner surface defining a compartment;

a flexible container filled with a flowable material, the flexible container located in the compartment;

the flexible container comprising

A. a front panel, a rear panel, a first gusseted side panel, and a second gusseted side panel, the gusseted side panels adjoining the front panel and the rear panel along peripheral seals to form a chamber;

B. each peripheral seal having (i) an arcuate body seal inner edge (ABSIE) with opposing ends, (ii) a tapered seal inner edge (TSIE) extending from each end of the body seal;

C. the flexible container comprises at least one ABSIE having a radius of curvature, Rc, from 1.0 mm to 300.0 mm;

the bag-in-box assembly comprising 1. a top perimeter, a center perimeter, and a bottom perimeter;

2. an aggregate contact length (ACL) at each perimeter wherein (i) a top ACL is from 50% to 90% of the top perimeter;

(ii) a center ACL is from 5% to 50% of the center perimeter; and (iii) a bottom ACL is from 50% to 90% of the bottom perimeter wherein the bag-in-box assembly passes a one meter drop test in accordance with drop test method A;

the box having an outer surface; and the bag-in-box assembly has an outermost surface consisting of the outer surface of the box.

2. The bag-in-box assembly of claim 1, wherein the box comprises an outer perimeter wherein the outer perimeter after the one meter drop test is equal to the outer perimeter before the one meter drop test.

3. A bag-in-box assembly comprising:

a box having an inner surface, the inner surface defining a compartment;

a flexible container filled with a flowable material, the flexible container located in the compartment;

the flexible container comprising:

A. a front panel, a rear panel, a first gusseted side panel, and a second gusseted side panel, the gusseted side panels adjoining the front panel and the rear panel along peripheral seals to form a chamber;

B. each peripheral seal having (i) an arcuate body seal inner edge (ABSIE) with opposing ends, (ii) a tapered seal inner edge (TSIE) extending from each end of the body seal;

C. the flexible container comprises at least one ABSIE having a radius of curvature, Rc, from 1.0 mm to 300.0 mm;

the bag-in-box assembly comprising 1. a top perimeter, a center perimeter, and a bottom perimeter;

2. an aggregate contact length (ACL) at each perimeter wherein (i) a top ACL is from 50% to 90% of the top perimeter;

(ii) a center ACL is from 5% to 50% of the center perimeter;

(iii) a bottom ACL is from 50% to 90% of the bottom perimeter; and wherein the bag-in-box assembly passes a one meter drop test in accordance with drop test method A.

4. The bag-in-box assembly of claim 3, further comprising a tap attached to the front panel, wherein the tap is in fluid communication with the chamber and wherein the box further comprises an opening through which a portion of the tap extends.

5. The bag-in-box assembly of claim 3, wherein the box comprises an aspect ratio of 3.3:1.

6. The bag-in-box assembly of claim 3, wherein the box comprises one or more cutouts.

7. The bag-in-box assembly of claim 3, wherein the box comprises a wall width wherein the wall width is from 2.4 mm to 3.2 mm.

8. The bag-in-box assembly of claim 3, wherein the flexible container comprises a bottom segment and a lower container volume wherein the lower container volume is defined by a volume from a center interface of the flexible container to the bottom segment wherein the lower container volume is greater than 50% of a total volume of the flexible container.

9. The bag-in-box assembly of claim 8, wherein the lower container volume is from 51% to 60% of the total volume of flexible container.

10. The bag-in-box assembly of claim 3, wherein the box has a side wall having a surface having an area from 355 $cm^2$ to 645 $cm^2$ when the flexible container has a volume from 3.7 L to 3.9 L.

11. The bag-in-box assembly of claim 3, wherein the radius of curvature, Rc, is from 8.5 mm to 10.5 mm.

12. A bag-in-box assembly comprising:

a box having an inner surface, the inner surface defining a compartment;

a flexible container filled with a flowable material, the flexible container located in the compartment;

the flexible container comprising:

A. a front panel, a rear panel, a first gusseted side panel, and a second gusseted side panel, the gusseted side panels adjoining the front panel and the rear panel along peripheral seals to form a chamber;

B. each peripheral seal having (i) an arcuate body seal inner edge (ABSIE) with opposing ends, (ii) a tapered seal inner edge (TSIE) extending from each end of the body seal;

C. the flexible container comprises at least one ABSIE having a radius of curvature, Rc, from 1.0 mm to 300.0 mm;

the bag-in-box assembly comprising 1. a top perimeter, a center perimeter, and a bottom perimeter;

2. an aggregate contact length (ACL) at each perimeter wherein (i) a top ACL is from 50% to 90% of the top perimeter;

(ii) a center ACL is from 5% to 50% of the center perimeter;

(iii) a bottom ACL is from 50% to 90% of the bottom perimeter; and wherein the bag-in-box assembly passes a one meter drop test in accordance with drop test method A; and the box comprises an outer perimeter wherein the outer perimeter after the one meter drop test is equal to the outer perimeter before the one meter drop test.

13. The bag-in-box assembly of claim 12, further comprising a tap attached to the front panel, wherein the tap is in fluid communication with the chamber and wherein the box further comprises an opening through which a portion of the tap extends.

* * * * *